US006376976B1

(12) United States Patent
Saitoh et al.

(10) Patent No.: US 6,376,976 B1
(45) Date of Patent: Apr. 23, 2002

(54) CATHODE-RAY TUBE HAVING OXIDE CATHODE AND METHOD FOR PRODUCING THE SAME

(75) Inventors: Kiyoshi Saitoh; Ryo Suzuki; Hiroshi Yamaguchi; Takashi Shinjo; Hiroyuki Teramoto; Takuya Ohira, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/462,071

(22) PCT Filed: May 13, 1999

(86) PCT No.: PCT/JP99/02461

§ 371 Date: Jan. 5, 2000

§ 102(e) Date: Jan. 5, 2000

(87) PCT Pub. No.: WO99/59178

PCT Pub. Date: Nov. 18, 1999

(30) Foreign Application Priority Data

May 14, 1998 (JP) ..... 10-132166

(51) Int. Cl.[7] ..... H01J 1/14

(52) U.S. Cl. ..... 313/346 R; 313/716 DC; 313/270; 313/440; 427/68; 427/77

(58) Field of Search ..... 313/346 R, 270, 313/440, 346 DC; 427/68, 77

(56) References Cited

U.S. PATENT DOCUMENTS

| | | | | | |
|---|---|---|---|---|---|
| 4,459,322 | A | * | 7/1984 | Lin | 427/77 |
| 5,459,372 | A | * | 10/1995 | Roh | 313/270 |
| 5,959,395 | A | * | 9/1999 | Sakurai | 313/346 R |
| 6,063,434 | A | * | 5/2000 | Rho et al. | 427/68 |
| 6,124,666 | A | * | 9/2000 | Saito et al. | 313/346 R |

* cited by examiner

*Primary Examiner*—Sandra O'Shea
*Assistant Examiner*—Guiyoung Lee
(74) *Attorney, Agent, or Firm*—Oblon, Spivak, McClelland, Maier & Neustadt, P.C.

(57) ABSTRACT

It is an object to obtain a cathode ray tube having a high resolution without decreasing electron emission property.

Surface of a cathode was leveled by heating during forming a vacuum in order to oxidize a carbonate salt to an oxide as an electron emissive material, after applying a paste for printing on a metal substrate by screen printing, drying the same, and incorporating an oxide cathode in a cathode ray tube, the paste having a mixture of needle-like particles of the first group and bulk particles of the second group incorporated as an alkaline earth metal carbonate forming an electron emissive material layer.

18 Claims, 14 Drawing Sheets

CATHODE-RAY TUBE HAVING OXIDE CATHODE AND METHOD FOR PRODUCING THE SAME

TECHNICAL FIELD

The present invention relates to a cathode ray tube having an oxide cathode and a process for preparing the same, particularly an electron emissive material layer in the cathode and a process for preparing the same.

BACKGROUND ART

In FIG. 14, a cross sectional view of a conventional oxide cathode is illustrated as a model which is described, for instance, in JP-A-8-77914. In the figure, 101 is a metal substrate which contains nickel as a major component and a reducer of, for instance, silicon and magnesium. The metal substrate 101 is a circular plate constituting the bottom of a long-cavity cylindrical sleeve 102. And 103 is an electron emissive material layer mainly comprising a needle-like particle 105 of oxides of alkaline earth metal such as barium, strontium and calcium, which adheres to the metal substrate 101. Also, 104 is a filament which is heated in order that thermoelectrons are emitted from the electron emissive material placed in the sleeve 102. The oxide cathode is placed in an evacuated cathode ray tube (no figure). In FIG. 14, the size of the needle-like particle 105 is enlarged about 10 times larger than the size (diameter and thickness) of the electron emissive material layer 103. Therefore, among the needle-like particles 105, except the needle-like particles 105 contacted to the metal substrate 101, the real width shows about one tenth of the total width from the surface.

A process for preparing the oxide cathode of the cathode ray tube is as follows:

At first, particles of the alkaline earth metal carbonate are dispersed in an organic solvent to prepare a dispersion solution (paste) having suitable viscosity for spraying. By repeating a process of spraying the paste onto the metal substrate 101 and drying the same, the pre-determined thickness, for instance, 40 to 100 $\mu$m is obtained. The oxide cathode is placed in the cathode ray tube, and by forming a vacuum inside the cathode ray tube, the cathode ray tube is heated from outside or by the filament 104. The organic solvent is decomposed and evaporated up to about 600° C., and by heating up the carbonate salt to about 900 to 1000° C., the carbonate salt is decomposed to give an oxide and the electron emissive material layer 103 is formed which emits electron.

The particles of the alkaline earth metal carbonate which form the electron emissive material is usually shaped like a needle and one of them is shown in a large scale in FIG. 15. As is shown in FIG. 15, the longest length of the particles of the alkaline earth metal carbonate 105 is defined as L $\mu$m and the longest axis vertical to the direction is defined as D $\mu$m, while the same definition is applied to the particles having nearly spherical shape in the followings. Usually, the particles having an average length L of about 4 to 15 $\mu$m and an average diameter D of about 0.4 to 1.5 $\mu$m are used as the particles of the carbonate. Though the oxide after decomposition process is slightly shrunk, the shape is almost kept. Due to the shape and the size of the particles and application by spraying, suitable voids are made to achieve high electron mission and a long duration. On the other hand, JP-A-8-77914, discloses an art in which a variation in the thickness of the electron emissive material layer is reduced and a long duration is achieved by partly using spherical or branched particles. JP-A-59-191226 discloses an art in which a paste of a carbonate salt is applied by printing.

The above preparation process of spraying may cause large unevenness of the surface of the electron emissive material layer as shown in FIG. 14, and therefore, electron beam is distributed irregularly along the uneven surface. The reason is, for example, that in case an electric field on the surface of the electron emissive material layer is not large, the electric field converges on the top of the convex and the electron emission of the convex part becomes larger than that of the concave part. A distribution of electron beam is preferably Gaussian distribution. When the distribution is irregular, there is a problem that a pitch of a shadow mask is interfered and moire easily occured.

In case unevenness of the surface of the electron emission layer was large, there was a problem that direction of electron emission tended to be easily expanded, and therefore, the beam tended to be expanded and resolution became lowered. On the other hand, in order to reduce the unevenness of the surface of the electron emissive material layer, there can be considered a process in which a paste containing the alkaline earth metal carbonate which forms the electron emissive material layer is applied on the metal substrate by printing. In the process, however, there was a problem that no suitable voids were made on the electron emissive material layer and an amount of the electron emission was smaller than that obtained by the process of spraying.

The present invention has been made in order to solve the above problems, and there is provided a process in which surface unevenness of an electron emissive material layer is reduced and a suitable voids are formed to obtain a cathode ray tube having a little moire and high resolution. In brief, the electron emissive material layer is constituted by using two particle groups having a different shape, and by applying a process in which the shape and the ratio of the particles is specified, an excellent cathode ray tube is obtained.

DISCLOSURE OF THE INVENTION

The first oxide cathode of the cathode ray tube of the present invention comprises an electron emissive material layer having an alkaline earth metal oxide on a metal substrate containing nickel as a major component, wherein the alkaline earth metal oxide comprises a mixture of needle-like particles of the first group and bulk particles of the second group which is different from the particles of the first group. An average length of the particles of the second group is at most 60% of that of the first group particles, an average diameter of the particles of the second group is at least 1.5 times larger than that of the first group particles and a ratio of the particles of the first group in the alkaline earth metal oxide constituting the electron emissive material layer is 50 to 95% based on the atomic ratio of the alkaline earth metal oxide.

The second oxide cathode of the cathode ray tube of the present invention is that in the oxide cathode of the first cathode ray tube, the particles of the second group are spherical particles having an average diameter of at most 7 $\mu$m.

The third oxide cathode of the cathode ray tube of the present invention is that in the oxide cathode of the first or second cathode ray tube, the particles of the second group comprises an oxide of at least barium and strontium, and the total amount of barium in the particles of the second group is at most 30% based on the atomic ratio of the alkaline earth metal oxide of the particles of the second group.

The fourth oxide cathode of the cathode ray tube of the present invention is that in the oxide cathode of the first, second or third cathode ray tube, the base on which an electron emissive material layer of a metal substrate is formed is a nearly circular shape having a diameter of r1 (mm) and the planar shape of the electron emissive material layer is a nearly circular shape having a diameter of r2 (mm), and the following equation is satisfied.

$$r2 \leqq r1 - 0.1$$

The fifth oxide cathode of the cathode ray tube of the present invention further has a layer containing, as a main component, tungsten or molybdenum between the metal substrate and the electron emissive material layer of the oxide cathode of the first, second, third or forth cathode ray tube.

The first process for preparing the oxide cathode of the cathode ray tube of the present invention comprises a process for applying, by printing, the paste for printing containing particles of the alkaline earth metal carbonate forming the electron emissive material on the metal substrate which contains nickel as a main component and constitutes the oxide cathode, a drying process in which the paste for printing applied in the above process is fixed on the metal substrate, and a process for heating during forming a vacuum to oxidize the alkaline earth metal carbonate to an oxide as the electron emissive material after the oxide cathode is incorporated in the cathode ray tube, wherein as the alkaline earth metal carbonate, there is used a mixture of needle-like particles of the first group and bulk particles of the second group which is different from the particles of the first group, an average length of the particles of the second group is at most 60% of that of the first group particle, an average diameter of the particles of the second group particle is at least 1.5 times larger than that of the first group particle, and a ratio of the particles of the first group in the alkaline earth metal oxide constituting the electron emissive material layer is 50 to 95% based on the atomic ratio of the alkaline earth metal oxide.

The second process for preparing the oxide cathode of the cathode ray tube of the present invention comprises a process for applying, by printing, the paste for printing containing particles of the alkaline earth metal carbonate forming the electron emissive material and particles for producing voids having an average diameter of 1 to 20 $\mu$m on the metal substrate which contains nickel as a main component and constitutes the oxide cathode, a drying process in which the paste for printing applied in the above process is fixed on the metal substrate, and a process for heating during forming a vacuum to oxidize the alkaline earth metal carbonate to an oxide as the electron emissive material after the oxide cathode is incorporated in the cathode ray tube, and in which the above particles for producing voids are removed while heating.

The third process for preparing the oxide cathode of the cathode ray tube of the present invention is that in the second process for preparing the cathode ray tube, a volume ratio of the particles for producing voids against the alkaline earth metal carbonate is 5 to 30%.

The forth process for preparing the oxide cathode of the cathode ray tube of the present invention is that in the third process for preparing the cathode ray tube, the particles for producing voids is acrylic resin powder.

The fifth process for preparing the oxide cathode of the cathode ray tube of the present invention is that in the second process for preparing the cathode ray tube, as the alkaline earth metal carbonate in the paste for printing, there is used a mixture of needle-like particles of the first group and bulk particles of the second group which is different from the particles of the first group, an average length of the particles of the second group is at most 60% of that of the first group, an average diameter of the particles of the second group is at least 1.5 times larger than that of the first group, and a ratio of the particles of the first group in the alkaline earth metal oxide constituting the electron emissive material layer is 50 to 95% based on the atomic ratio of the alkaline earth metal oxide.

The sixth process for preparing the oxide cathode of the cathode ray tube of the present invention is that in the first, second, third, forth or fifth process for preparing the cathode ray tube, the process for applying the paste by printing is carried out by using a screen printing.

The seventh process for preparing the oxide cathode of the cathode ray tube of the present invention is that in the sixth process for preparing the cathode ray tube, the paste for printing contains at least one of a nitrocellulose solution and an ethylcelluloce solution, terpineol and a dispersion agent, the paste has a viscosity of 2,000 to 10,000 cP, a mesh of No. 120 to 500 is used during the process of applying the paste for printing and the thickness of the paste for printing after the drying process is 40 to 150 $\mu$m.

The eighth process for preparing the oxide cathode of the cathode ray tube of the present invention is that in the sixth or seventh process for preparing the cathode ray tube, the surface of the metal substrate forming the electron emissive material layer is a nearly circular shape having a diameter of r1 (mm) and the shape of an opening part of a mask for screen printing is a nearly circular shape having a diameter of r2 (mm), and satisfying $$r2 \geqq r1 - 0.1.$$

The ninth process for preparing the oxide cathode of the cathode ray tube of the present invention is that in the first, second, third, forth, fifth, sixth, seventh or eighth process for preparing the cathode ray tube, the surface of the metal substrate is concave, on which the electron emissive material layer is formed.

The tenth process for preparing the oxide cathode of the cathode ray tube of the present invention is that in the first, second, third, forth, fifth, sixth, seventh, eighth or ninth process for preparing the cathode ray tube, shape of the paste for printing after drying or shape of the electron emissive material layer is convex toward a direction of electron extraction, at least on the part from which the electron is extracted.

The eleventh process for preparing the oxide cathode of the cathode ray tube of the present invention is that in the tenth process for preparing the cathode ray tube, the surface of the metal substrate is convex on which the electron emissive material layer is formed.

BEST MODE FOR CARRYING OUT THE INVENTION

Example 1

Figure 1:
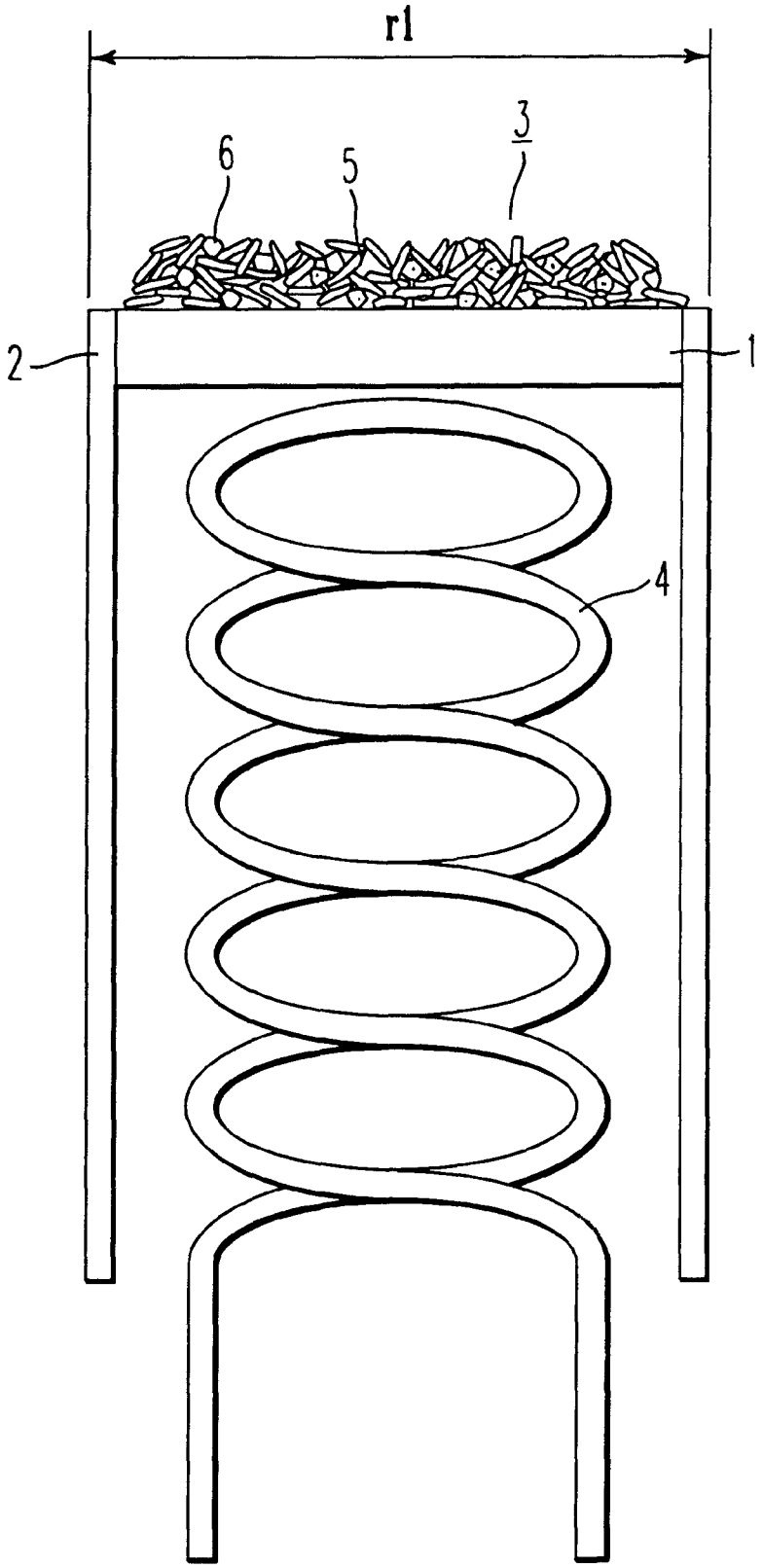
FIG. 1 is an enlarged cross sectional view of the oxide cathode of Example 1 of the present invention.

Examples of the present invention are explained below in accordance with the figures. FIG. 1 is an enlarged cross sectional view of the oxide cathode of the cathode ray tube of Example 1 of the present invention. In the figure, 1 is a disc-like metal substrate, 2 is a sleeve supporting the metal substrate, 3 is an electron emissive material layer mainly comprising oxide particles of the alkaline earth which are applied on the metal substrate 1, and 4 is a filament which heats the electron emissive material layer and the oxide cathode is placed inside a cathode ray tube (no figure) which is kept in a vacuum. The particles of the alkaline earth metal oxide forming an electron emissive material layer comprise needle-like particles 5 of the first shape and spherical particles 6 of the second shape. The amount of the former first particles is more than that of the second particles. The first particles have longer average length L than that of the second particles, while the first particles have smaller average diameter D than that of the second particles. Due to accumulation of these two kinds of particles, suitable voids and holes on the surface are formed, and therefore, an amount of electron emission is obtained as much as usual. On the other hand, there are many small holes on the surface but no large unevenness is observed. Moire is hardly observed and a diameter of electron beam become smaller to give higher resolution. In FIG. 1, the sizes of each particle 5 and 6 of the oxide of alkaline earth metal are enlarged about 10 times larger than the size (diameter and thickness) of the electron emissive material layer 3. Therefore, among the particles 5 and 6, except for particles contacted to the metal substrate 1, the real width shows about one tenth of the total width from the surface. (Cross sectional view of an oxide cathode hereinafter are illustrated in the same condition and particles for producing voids mentioned below are shown by enlarging 10 times as large as the particles). Concrete evaluation methods of an amount of electron emission, moire and electron beam and evaluation results thereof are described in detail in Examples.

Figure 2:
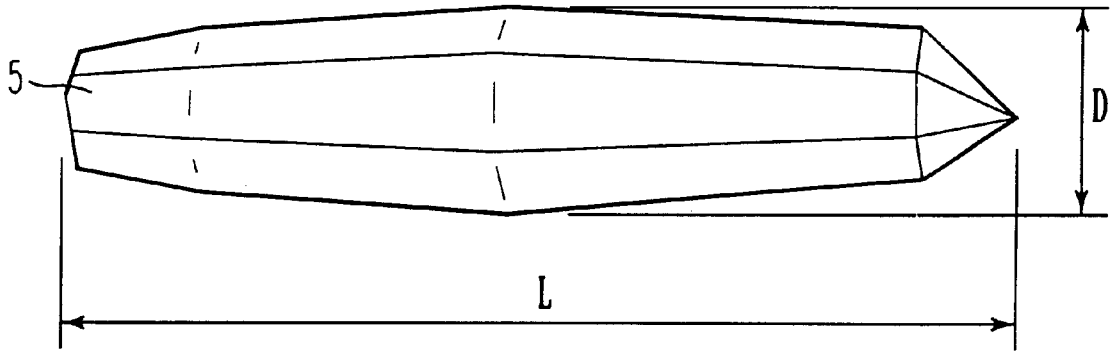
FIG. 2 is an enlarged view showing the particles of the first group of the alkaline earth metal carbonate which forms the electron emissive material of the oxide cathode of Example 1 of the present invention.
Figure 3:
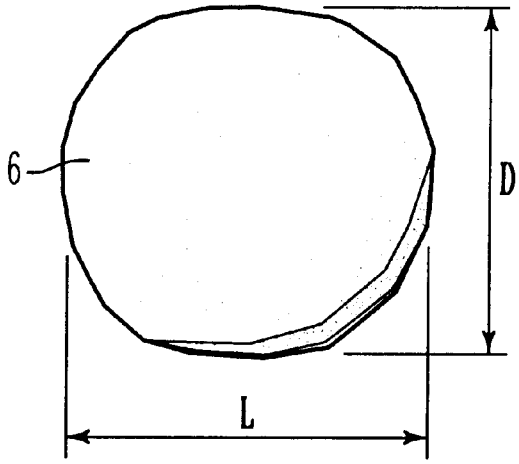
FIG. 3 is an enlarged view showing the particles of the second group of the alkaline earth metal carbonate which forms the electron emissive material of the oxide cathode of Example 1 in the present invention.

A process for preparing the above cathode ray tube is as follows: as particles of alkaline earth metal carbonate such as barium, strontium and calcium which form an electron emissive material, two shapes of particle are used. The first particle group has an average length L of 4 to 15 $\mu$m, an average diameter D of 0.4 to 1.5 $\mu$m and a ratio L/D of about 5 to 20, and is shaped like a needle as shown in FIG. 2. The second particle group has a nearly spherical shape, and a length L and a diameter D thereof are almost the same, the average length is at most 60% of the average length L of the first particle group, the average diameter is at least 1.5 times longer than the average diameter of the first particle group. As mentioned above, for both of the first and the second particle groups, L is defined as a length along with the longest axis of the particle and D is defined as the longest length of a cross section vertical to the axis. An average in this case is arithmetically calculated from measured values of the size as it is, and is not weighted as in volume average or surface area average. The same definition of the average size calculation applies to the followings. That is, regarding the aimed particle group, for instance, the sizes of particles in a number of n, measured by a secondary electron scanning microscope, are calculated arithmetically as it is. If an average length is defined as Lave, $Lave=\Sigma L/n$.

An atomic ratio among barium, strontium and calcium is, for instance, 0.5:0.4:0.1 in both particle groups. The two particle groups of the alkaline earth metal carbonate are produced separately and mixed. In the mixing, a ratio of the particles of the first group to the particles of the second group is 50 to 95% in terms of the atomic ratio of each alkaline earth metal carbonate. Particles of scandium oxide of 0.2 to 5% by weight based on the alkaline earth metal carbonate, terpineol as a solvent, a dispersion agent and a nitrocellulose solution and an ethylcelluloce solution as a binding agent are mixed to give a paste for printing having viscosity of 2,000 to 10,000 cP.

The paste for printing is printed to the metal substrate of the oxide cathode according to screen printing. A screen mesh for the screen printing is No.120 to 500 (the number specified in JIS). The open part of the mask for the screen printing is made almost circular and the diameter r2 thereof is made at least 0.1 mm smaller than the diameter r1 of the metal substrate ($r2 \leqq r1-0.1$). Then the paste is dried.

As shown in FIG. 1, the diameter r1 of the metal substrate 1 shows a diameter of a base of a cylinder, which comprises sleeve 2 and metal substrate 1. Therefore, the end of sleeve 2 is also included. A thickness of the paste for printing after drying is 40 to 150 $\mu$m. It is incorporated to the cathode ray tube and an air is removed. While removing the air, temperature is increased and firstly organic components such as terpineol, the remaining components of the dispersion agent and the binding agent are decomposed and evaporated. The temperature is increased by using filament 4 and carbonate salt is decomposed to oxide to form an electron emissive material layer 3. After completion, the electron emissive material layer 3 comprises the alkaline earth metal oxide and, in this case, scandium oxide.

Though the above drying process is carried out in an oven at about 1000 to 140° C., air drying can be employed, or the process can also be included in the following air-removing process. In brief, it is preferable that the liquid component is removed and the paste is fixed on condition that flaw or crack in the electron emissive material layer is not formed due to sudden evaporation.

In the above process, though the scandium oxide particles of 0.2 to 5% by weight based on the alkaline earth metal carbonate may not be mixed, the prepared cathode ray tube has more excellent properties if the particles are mixed.

Figure 4:
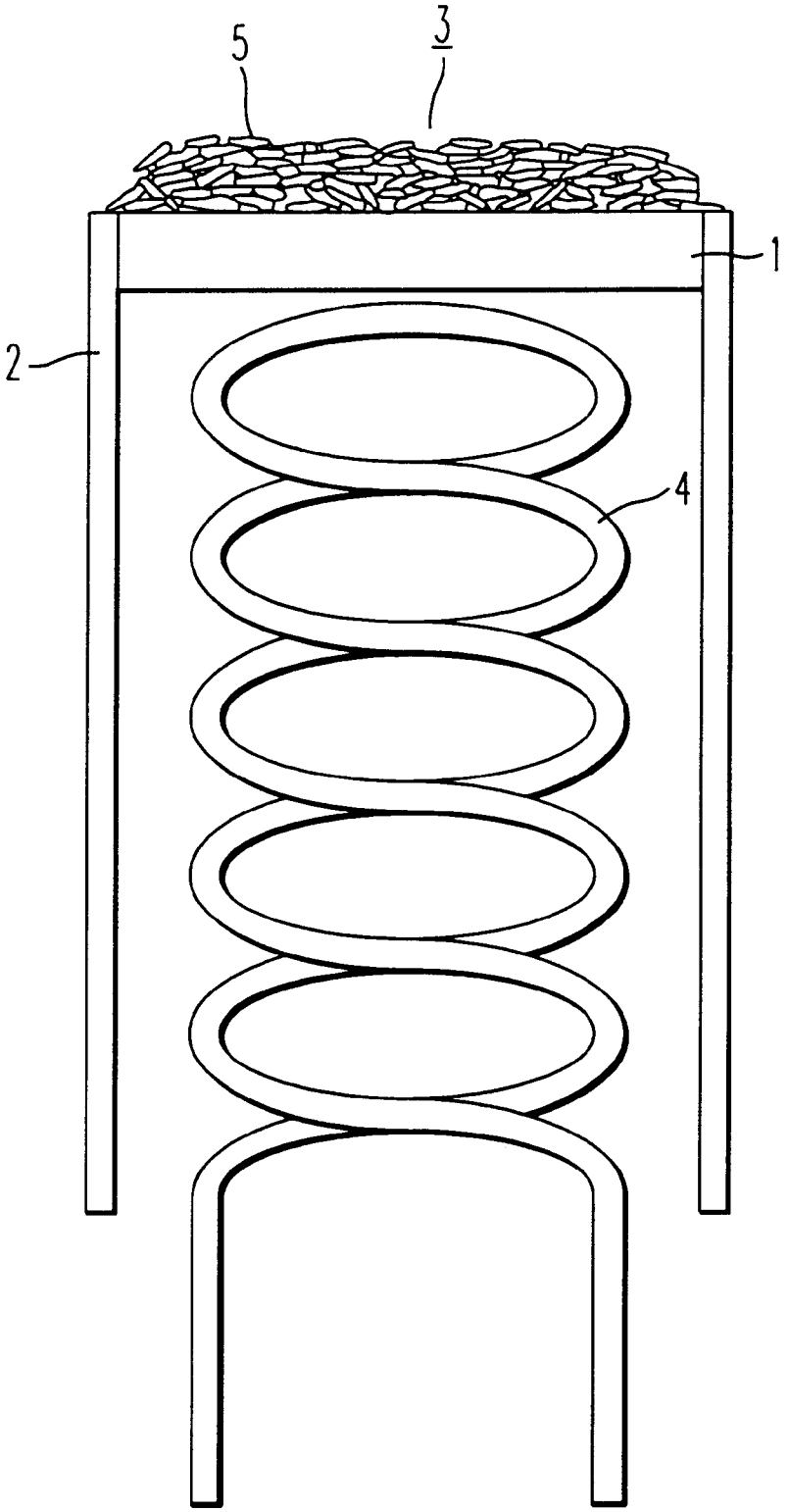
FIG. 4 is an enlarged cross sectional view of the oxide cathode of Comparative Example 1 of the present invention.
Figure 14:
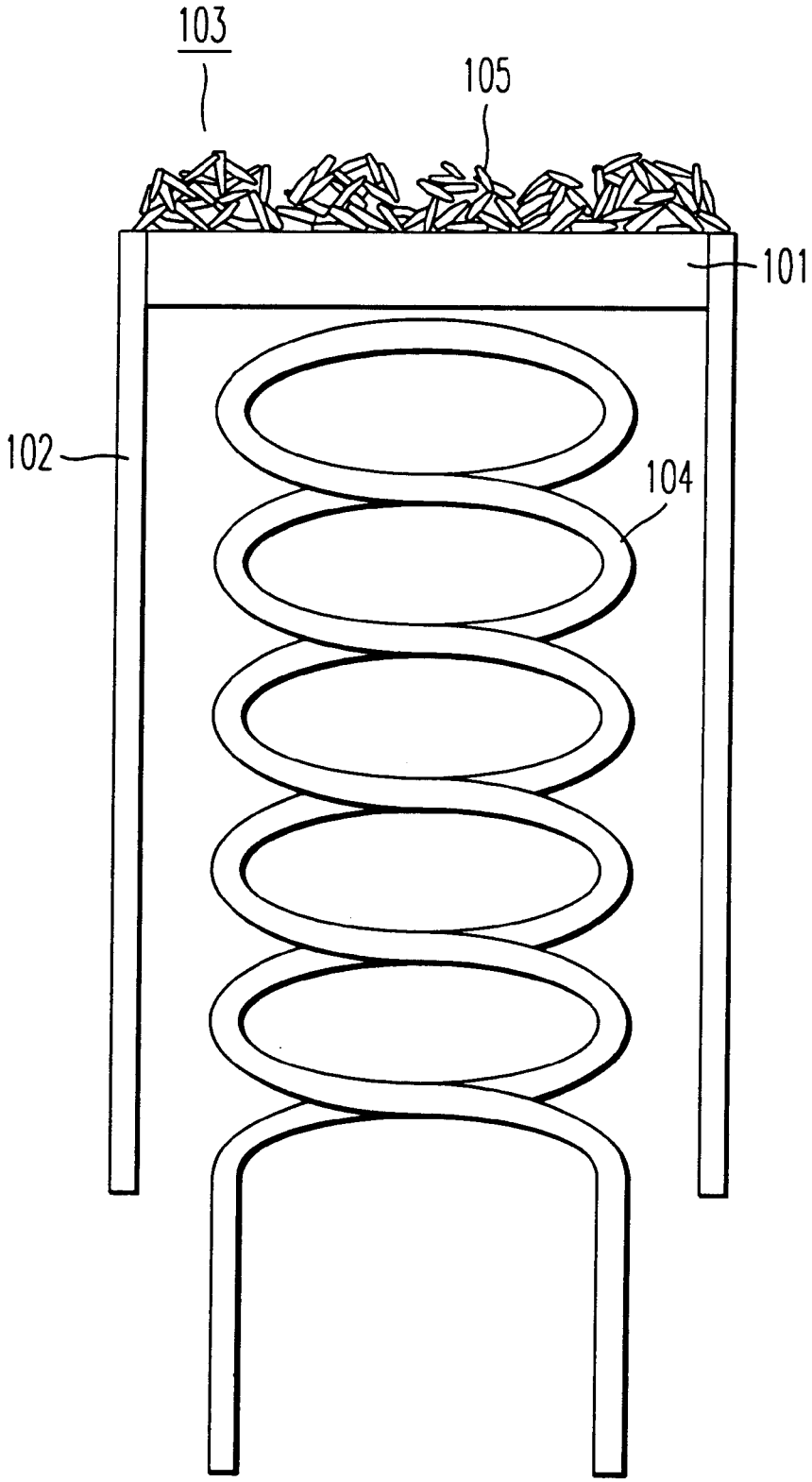
FIG. 14 is an enlarged cross sectional view showing an example of a conventional oxide cathode.
Figure 15:
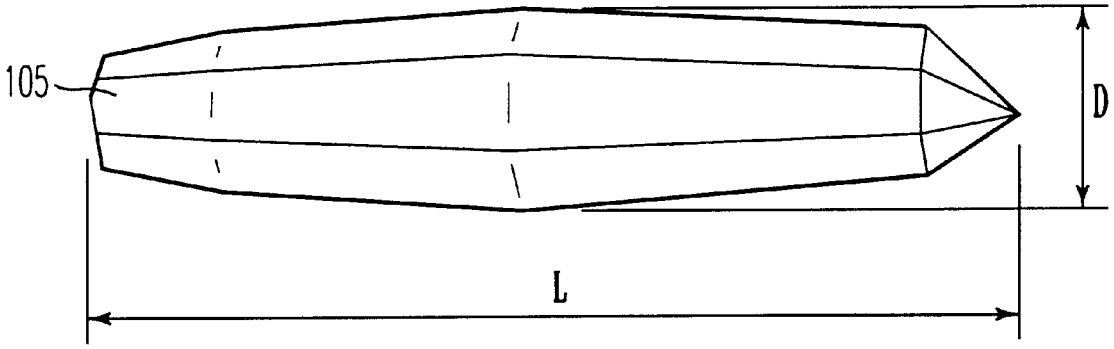
FIG. 15 is an enlarged model for illustrating an example of particles of an alkaline earth metal carbonate for electron emissive material which have been employed for a conventional oxide cathode.

On the other hand, in case of a conventional structure in which only needle-like particles are used instead of using two kinds of particles, the particles tend to lie along the metal substrate 1 because of the pressure of the screen printing. FIG. 4 shows a cross sectional view of a cathode ray tube prepared according to the screen printing by using only needle-like particles. After evaporation and drying of liquid organic components, voids are not formed therein and a distance between each particle becomes short. Therefore, voids are difficult to be formed. In case a spray is used as in the conventional process as mentioned above, since carbonate salt components and liquid organic components are piled up without pressure, position of the carbonate salt components remains the same after drying of the liquid organic components as shown in FIG. 14, and thereby, voids are increased. In FIG. 1 showing Example 1, since needle-like particles, as a major component, are mixed with the shorter and thicker second particles, the needle-like particles of the first group have a little tendency to lie along the metal substrate 1 and the position remains almost the same after drying in the presence of the particles of the second group even under the pressure of the screen printing. Therefore, voids are formed, and particularly, deep and fine unevenness is formed on the surface, which makes an amount of electron emission equal to that in a conventional example.

On the other hand, accumulation of particles of the carbonate salt can never be controlled in case of a conventional process of using a spray. Further, since viscosity of the paste must be small in consideration of uniformity and blinding, particles easily agglomerate, and random and large winding unevenness having dozen $\mu$m size level is made as shown in FIG. 14, which brings about moire and increase of a diameter of electron beam. On the other hand, in EXAMPLE 1, though unevenness is formed, it has about the same size as the particles and the thickness thereof is about at most 10 $\mu$m. Therefore, moire is hardly observed and a diameter of electron beam became smaller.

A condition to make voids by screen printing, that is, a condition to prevent the needle-like particles from lying along the metal substrate, which is easily influenced by the size and the ratio of these two groups of particles, is that an average of particle length L of the second group is at most 60% of an average particle length L of the first group and an average particle diameter D of the second group is at least 1.5 times larger than an average particle diameter D of the first group. Particularly, in case the former condition is not satisfied, unevenness of an amount of electron emission is increased.

Even if the amount of the first group particles is more than 95% based on the atomic ratio of the alkaline earth metal in carbonate salt, the needle-like particles seldom lie parallel to the metal substrate in the presence of 3% of the second group particles if the condition of the size is within the above range. However, unevenness of density is increased and unevenness of an amount of electron emission is also increased. Therefore, the ratio of the needle-like particles of the first group may be at most 95% in order to keep a stable preparing condition. It is considered that the reason why voids are formed according to screen printing by mixing the second group particles having such a condition is because the needle-like particles do not fall down parallel to the metal substrate with support of the particles of the second group.

Generally, the needle-like particles having a larger ratio (L/D) of length L to diameter D have better electron emission property. Therefore, if a ratio of the second group particles increases, an amount of electron emission begins to decrease. The amount of electron emission does not decrease largely in particular if the ratio of the particles of the first group is at least 50%. Electron emission property is excellent in the case of using particles of a larger L/D. Though electron emission becomes excellent if there are slightly more alkaline earth metal atoms than oxygen atoms, barium atoms are supplied from the surface of each particle, and therefore, particles of larger L/D, namely having a large surface area compared to the volume, may be considered to have more alkaline earth metal atoms than oxygen atoms. It is presumed that this is why the electron emission property becomes excellent.

Figure 5:
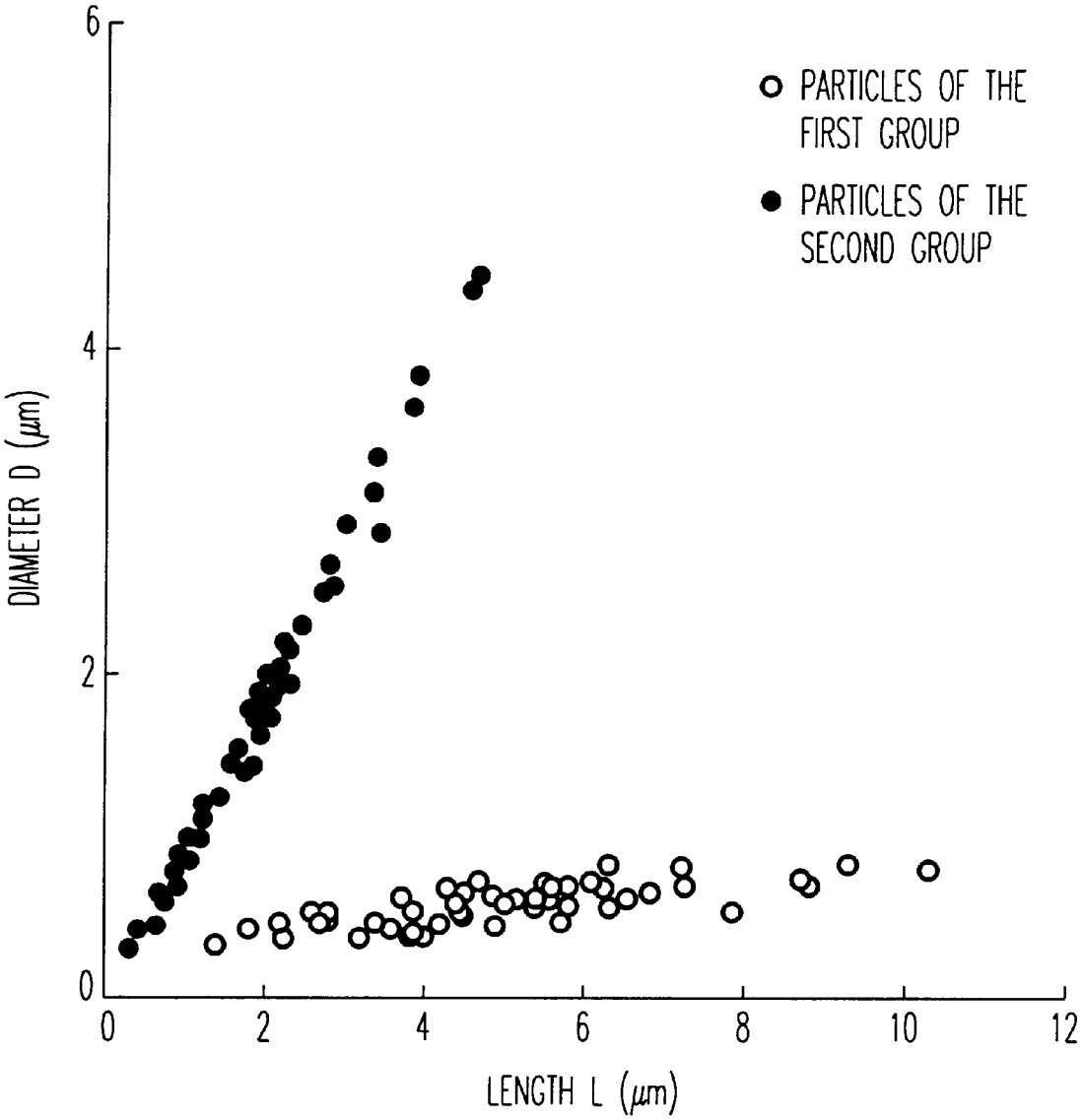
FIG. 5 is a distribution of the length L and the diameter D of the particles of the first and the second groups of the alkaline earth metal carbonate which form the electron emissive material of the oxide cathode of Example 1 of the present invention.

Though distribution concerning the size of length L and the diameter D of the two groups may overlap partially as is shown in FIG. 5, they are separated in two definite groups. In FIG. 5, ○ is the particles of the first group and ● is the particles of the second group. Generally, such carbonate salt is prepared by dissolving barium nitrate, strontium nitrate or calcium nitrate in water, adding a precipitant and coprecipitating the above. Shape and size of the particles can be controlled, for instance, by selecting kinds of the precipitant (sodium carbonate, ammonium carbonate and the like), an amount thereof, and in some case, by adding the other additives for adjusting pH, and the two groups of particles may be prepared separately in different conditions.

As mentioned above, the size of the particles of the first and second groups are determined mainly by the condition of producing voids. Since the particles of the second group tend to have a lower amount of electron emission, which cause to produce irregular electron beam if an average diameter of the particles of the second group is too large, the average is preferably smaller than about 7 $\mu$m.

As mentioned above, if the applied thickness of the paste for printing after drying process is 40 to 150 $\mu$m, it is desirable in both points of duration and an amount of electron emission. On the other hand, if the thickness is at most 40 $\mu$m, due to evaporation of barium during running, the ratio of barium in the electron emissive material layer is decreased to give a short duration and if it is at least about 150 $\mu$m, the amount of electron emission tends to decrease. The reason for the latter is as follows: as mentioned above, though electron emission becomes excellent if there is slightly more alkaline earth metal atoms than oxygen atoms, an atomic ratio of the alkaline earth metal is increased because barium oxide is reduced by a reducer such as silicon which is included in the metal substrate and barium metal is produced on the interface between the metal substrate and electron emissive material layer. The barium atoms are diffused through the electron emissive material layer and reach the particles close to the surface to emit electrons. Therefore, it is considered that if the electron emissive material layer becomes thick, it becomes difficult for the barium atoms to reach from the interface of the metal substrate, the particles close to the surface and an amount of the electron emission begins to decrease.

It is a problem in terms of production and decrease of an amount of electron emission if the maximum thickness of 150 $\mu$m is largely exceeded.

If lap printing is carried out, there is a tendency that the overlapped interfaces do not adhere well, an amount of electron emission is decreased and that the pre-printed part is easy to peel off from the metal substrate. Furthermore, a density tends to be increased if the layer to be printed is thin, and electron emission property is lowered. Therefore, printing is preferably carried out for one time to obtain the above thickness which is thicker than a normal printing thickness.

As mentioned above, the paste for printing is prepared to contain at least one of a nitrocellulose solution and an ethylcellulose solution, terpineol and a dispersion agent, having a viscosity of 2,000 to 10,000 cP(centipoise) in this EXAMPLE. These are conditions for printing the paste by only one printing to obtain the above thickness, uniformity without peeling off. If the viscosity is under the above range, thicker thickness is difficult to be obtained, and the center part of the printed paste becomes thick while the peripheral part becomes thin to make a large thickness distribution of film. If the viscosity is over the above range, it becomes difficult for the paste for printing to come out of the screen and defects may be made particularly in the peripheral part of the printing surface. Further, there are tendencies that voids are difficult to be made and an amount of the electron emission is decreased if the viscosity is large. In a cathode ray tube, a range for electron extraction from an oxide cathode is about 0.2 to 0.6 mm, which is the range of an electron passing hole opened on the first grid for electrons to pass secondly. Normally, it is enough if the condition for printing thickness is satisfied only within the above range, and definite uniformity of the above printing thickness is not required. However, if the thickness of the electron emissive material layer is uniform, margin of accuracy for assembling the first grid and the oxide cathode can be preferably increased in terms of production.

Mesh of the printing screen is from 120 to 500. If the mesh is finer than this, it becomes difficult for the paste to pass through the mesh. While if it is looser, the mesh pattern tends to remain on the printed surface as unevenness which may cause to produce moire or increasing a diameter of electron beam.

Opening against the part masked by the screen is made almost circular, and the diameter r2 is at least 0.1 mm shorter than the diameter r1 of the metal substrate. The reason is as follows: if the edge of the paste for printing is slightly expanded to reach the side part of the sleeve 2 as the metal substrate, the paste is carried to the side surface in a large amount due to the printing pressure, and the peripheral thickness is reduced and thickness become uneven; since the expanding range is at most 0.1 mm in a diameter, uneven thickness is not made if the opening size is determined within the above range.

Though an example of screen printing was illustrated in the above Example 1 as a printing process for forming electron emissive material layer, the printing process is not limited to the screen printing. The surface of electron emissive material layer can be made even through the other printing processes. Further, there are similar problems of an electron emission amount or duration in the other printing processes as well, and the condition of the alkaline earth metal carbonate in the paste for printing shown in the above example is effective for solving the problems.

Examples of printing process are letterpress printing, planographic printing, intaglio printing, mimeograph printing and the like. Particularly, as a method of controlling thickness of paste easily, there are effective process such as intaglio printing, meshless mimeograph printing in which a mask alone is used instead of a mesh, and indirect printing (transcribing printing) in which printing is once made on a flat rubber board and the like by using these methods, to transcribe on the metal substrate.

A composition or viscosity of a binder (such as nitrocellulose), a solvent (such as terpineol) and a dispersion agent and mesh conditions are conditions for screen printing, which are different from that in case of the other printing methods. For instance, though viscosity of the paste may be set higher than that of the screen printing in intaglio printing, meshless mimeograph printing and transcribing printing, there is a case where deformation of the paste due to defects does not easily occur depending on the other conditions. Also, if viscosity is set higher, there is a case where adhesion of the paste to the metal substrate is lowered while there is a case where adhesion is excellent if the binder is abundantly mixed. Kinds and composition of the above binder, solvent and dispersion agent may be adjusted under conditions suitable for each printing process.

Example 2

Figure 6:
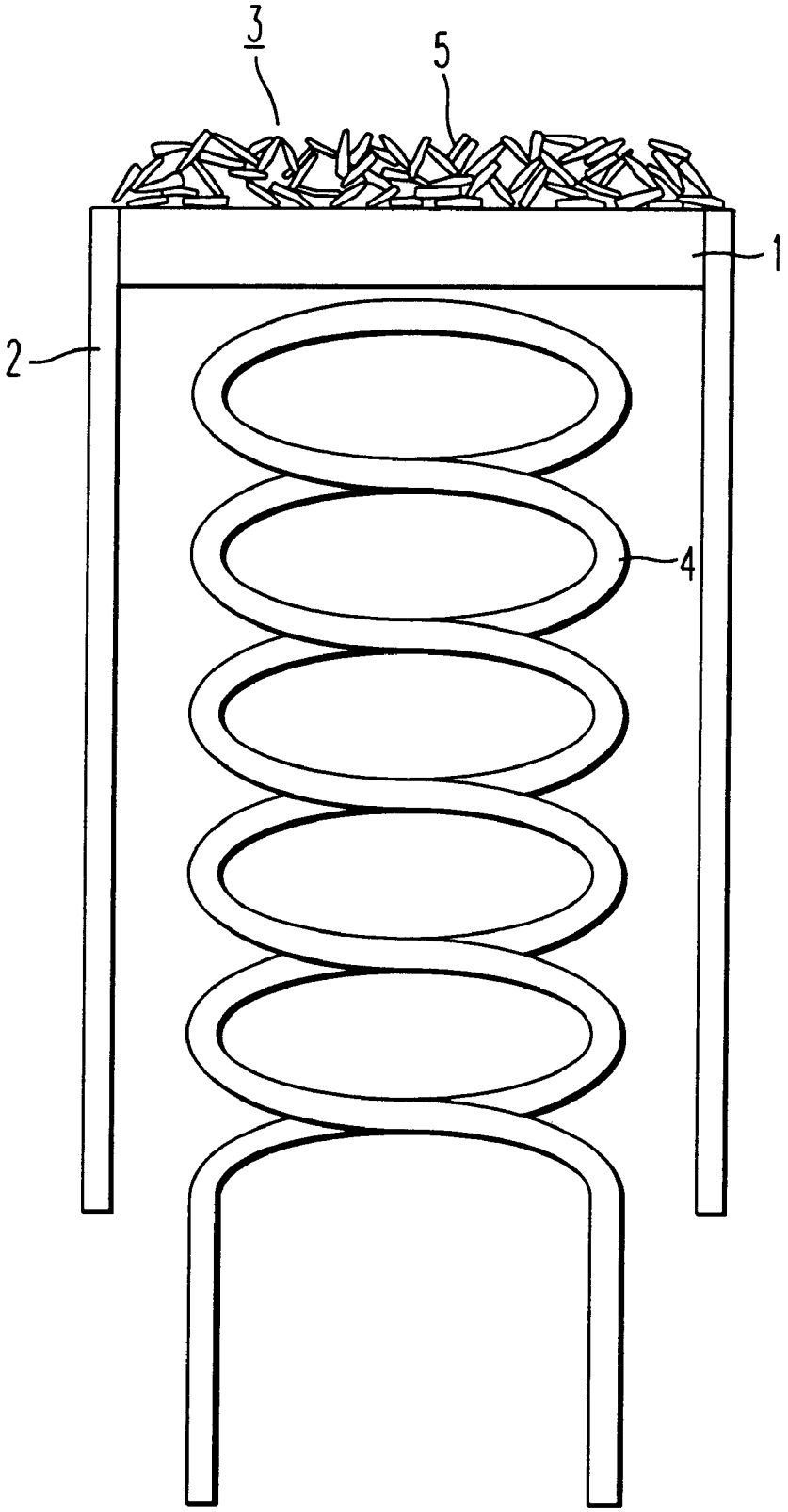
FIG. 6 is an enlarged cross sectional view of the oxide cathode of Example 2 and FIG. 7 is an enlarged cross sectional view of the oxide cathode of Example 2 after a drying process.
Figure 7:
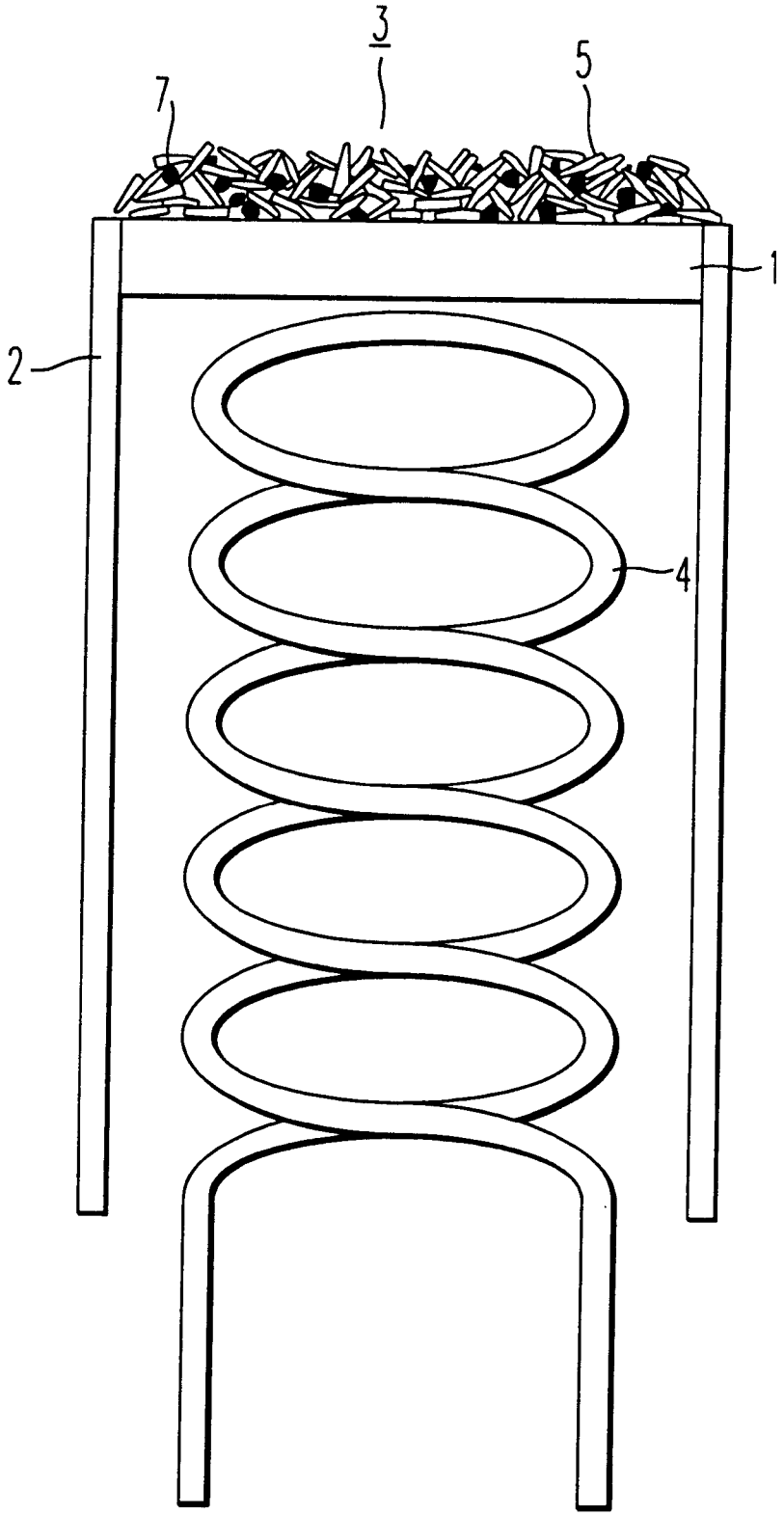

In the followings, an another embodiment of the present invention is illustrated according to the figure. FIG. 6 is an enlarged cross sectional view of an oxide cathode of a cathode ray tube prepared in EXAMPLE 2. FIG. 7 is a cross sectional view of the same cathode in the same position after a paste for printing is applied and dried which forms an electron emissive material layer in order to produce the cathode ray tube in FIG. 6. As is shown in FIG. 7, the layer 3 forming an electron emissive material layer mainly comprises particles 5 of alkaline metal carbonate and particles for producing voids 7. After completion of a cathode ray tube, the particles for producing voids do not remain due to decomposition and evaporation and voids are formed in the position where the particles were present. Namely, suitable voids, and particularly, holes on the surface are formed. Therefore, an amount of electron emission is obtained as much as that in usual. On the other hand, though there are numerous small holes on the surface, no large unevenness is observed, moire was hardly observed, and resolution was increased due to a shortened diameter of electron beam.

A process for preparing a cathode ray tube according to this EXAMPLE is as follows. As particles of alkaline earth metal carbonate such as barium, strontium and calcium, for instance, needle-like particles are used, and they have an average length L of 4 to 15 $\mu$m, an average diameter D of 0.4 to 1.5 $\mu$m and a ratio L/D of about 20 to 5. A paste for printing is made using particles of 5 to 30% by volume ratio against the alkaline earth metal carbonate, which have an average diameter of 1 to 20 $\mu$m, the paste containing particles for producing voids which are almost completely decomposed to evaporate at 600° C. or less and carbonate salts. The particles for producing voids 7 are, for instance, acrylic resin powder which is completely evaporated at 500° C. in one case. Other compositions of the paste for printing, viscosity, printing conditions are the same as in Example 1. A paste for printing is prepared, and after printing, an oxide cathode is dried at about 100 to 140° C. in one case. Voids material remains solid before the drying process is completed. Thickness of the paste for printing is 40 to 150 $\mu$m.

The above is incorporated into a cathode ray tube and a vacuum is formed. With evacuating, a temperature is increased and organic components such as terpineol, the remaining components of the dispersion agent and the binding agent are decomposed, evaporated and then removed. By using filament 4 or other heating processes, a temperature is increased up to a temperature of 600° C. or less at which particles for producing voids are decomposed and evaporated, in this case 500° C., and the particles for producing voids are decomposed and evaporated. Due to the evaporation of the particles for producing voids, accumulation and structure of the particles of the alkaline earth metal carbonate are seldom influenced and voids remain in the position where the particles for producing voids disappeared.

After that, a temperature is increased by using filament 4, carbonate is decomposed to an oxide to complete an electron emission layer 3. Though the carbonate is slightly shrunk to become an oxide, the accumulation and structure of the particles remain the same, and the position where the particles for producing voids disappeared remain voids after completion. Further, though the above drying process can be carried out in an oven of a pre-determined temperature, air drying can also be employed, or the process can also be included in the following air-removing process. Preferably, the liquid component is removed and the paste is fixed on condition that flaw or crack in the electron emissive material layer is not formed due to a sudden evaporation and that the particles for producing voids remain solid until the paste is fixed.

Particles for producing voids are not limited to acrylic resin powder. Particles may be used such that remain as a particle after a drying process at a lower temperature after printing and that are completely decomposed and removed through heating in a vacuum at 600° C. or less. Inside structure of the layer made by applying the paste easily changes and an effect of adding the particles for producing voids is lost since structure supported by the particles is changed in case the shape of the particles is not kept due, to melting, liquefaction, decomposition or evaporation.

In case the particles for producing voids continue to decompose and evaporate, and cannot be removed even at over 600° C., an amount of electron emission is decreased as described below. Carbonate salts of alkaline earth metal begin to decompose to an oxide at about 600° C. Though an amount of electron emission becomes small due to sintering if a vacuum is not sufficiently obtained during the decomposition, the phenomenon occurs when there is gas derived from the decomposition and evaporation of the particles for producing voids. When the obtained alkaline earth metal oxide reacts with the gas derived from the decomposition of particles for producing voids and becomes, for instance, a hydroxide other than an oxide, electron emission is hardly seen in the part. Therefore, it is necessary that decomposition and evaporation of particles for producing voids are finished before reaching 600° C. Further, though it is not inevitable, it is effective that increasing temperature is suspended for dozens of minutes at the temperature at which particles for producing voids are completely decomposed and evaporated.

In the conventional process of spraying an electron emissive material, unevenness of an amount of electron emission becomes large and voltage, which cuts off electron emission by grid (which corresponds to a necessary voltage for black display hereinafter referred to as cut-off voltage), tends to drastically change during duration tests. The reasons are as follows: structure of carbonate salt particles made by spraying is based on originally unstable structure of needle-like particles, and therefore, when voids are formed according to particles for producing voids, the structure is broken at completion to cause unevenness of an amount of electron emission. Also, it is because cut-off voltage suddenly changes due to evaporation of barium in the electron emissive material layer and a sudden collapse during operation when operation time is long.

On the other hand, when printing is used for forming the electron emissive material layer, unevenness of an amount of electron emission is not so large even by using particles for producing voids, and a sudden change of the cut-off voltage was hardly seen during duration tests. The reason is that, the layer does not collapse at completion or in case a certain amount of barium is evaporated because particles of alkaline earth metal carbonate are strongly pressed to the metal substrate during printing and structure of the carbonate salt particles are stable even voids are made according to the particles for producing voids.

However, in the process of Example 2 employing the particles for producing voids, unevenness of an amount of electron emission is slightly larger though an amount of electron emission is more excellent compared with EXAMPLE 1 in which two kinds of particles are used. The reason is considered that, even by printing, the structure made by electron emissive material particles is slightly unstable after evaporation of particles for producing voids.

It is necessary that the above particles for producing voids is 5 to 30% by volume based on the alkaline earth metal carbonate in the paste for printing. In case it is not more than 5%, an effect of adding the particles for producing voids is small and an amount of electron emission is small. In case particles for producing voids are used, unevenness of an amount of electron emission is large, but in particular, if it is not less than 30%, probability is high, wherein voids cannot be formed in the position where the particles disappeared after decomposition and evaporation of the particles. Further, the completed electron emissive material layer tends to collapse and unevenness of an amount of electron emission becomes large as a whole. Therefore, in the rage of 5 to 30%, it is effective enough even though unevenness is slightly seen.

If an average diameter of particles is shorter than 1 $\mu$m, size of voids is insufficient and an effect of addition of the particles is small. If the average diameter of particles is longer than 20 $\mu$m, there is a case where irregularity of electron beam distribution is made which corresponds to a trace of the particles for producing voids on the surface position, to cause moire. In the rage of 1 $\mu$m to 20 $\mu$m, such a case is not seen and the effect is sufficiently seen.

A diameter D of the particles for producing voids is referred to as the longest length of a cross section vertical to the longest axis of a particle. An average diameter of particles is arithmetic average of diameter of the particles in a group. The definitions are the same as the definition of size and average of the alkaline earth metal carbonate forming the electron emissive material layer.

Though spherical particles were used as an example here, the shape need not be spherical, and the effect is observed if the size condition is satisfied.

Example 3

Figure 8:
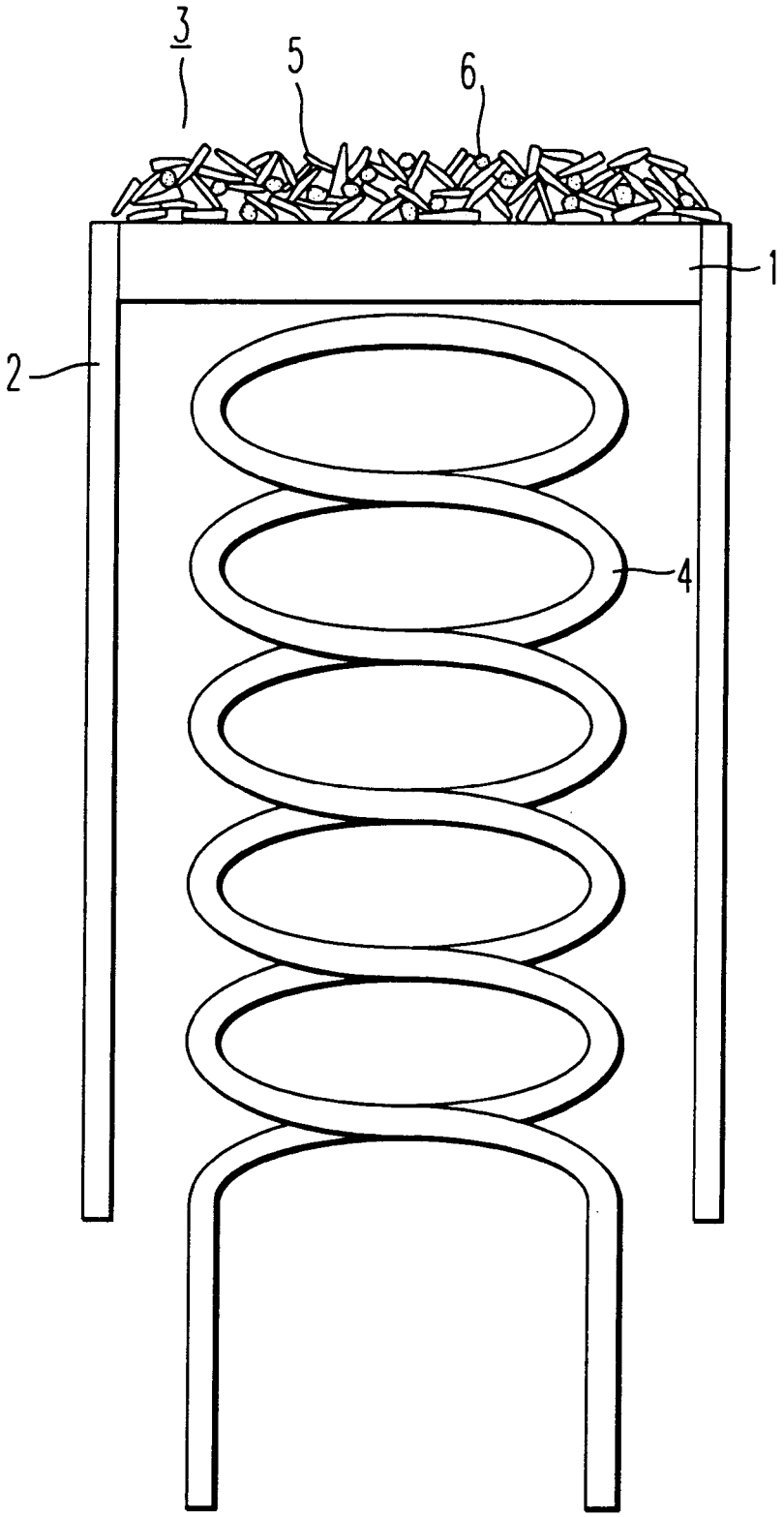
FIG. 8 is an enlarged cross sectional view of the oxide cathode of Example 3 and FIG. 9 is an enlarged cross sectional view of the oxide cathode of Example 3 after a drying process.
Figure 9:
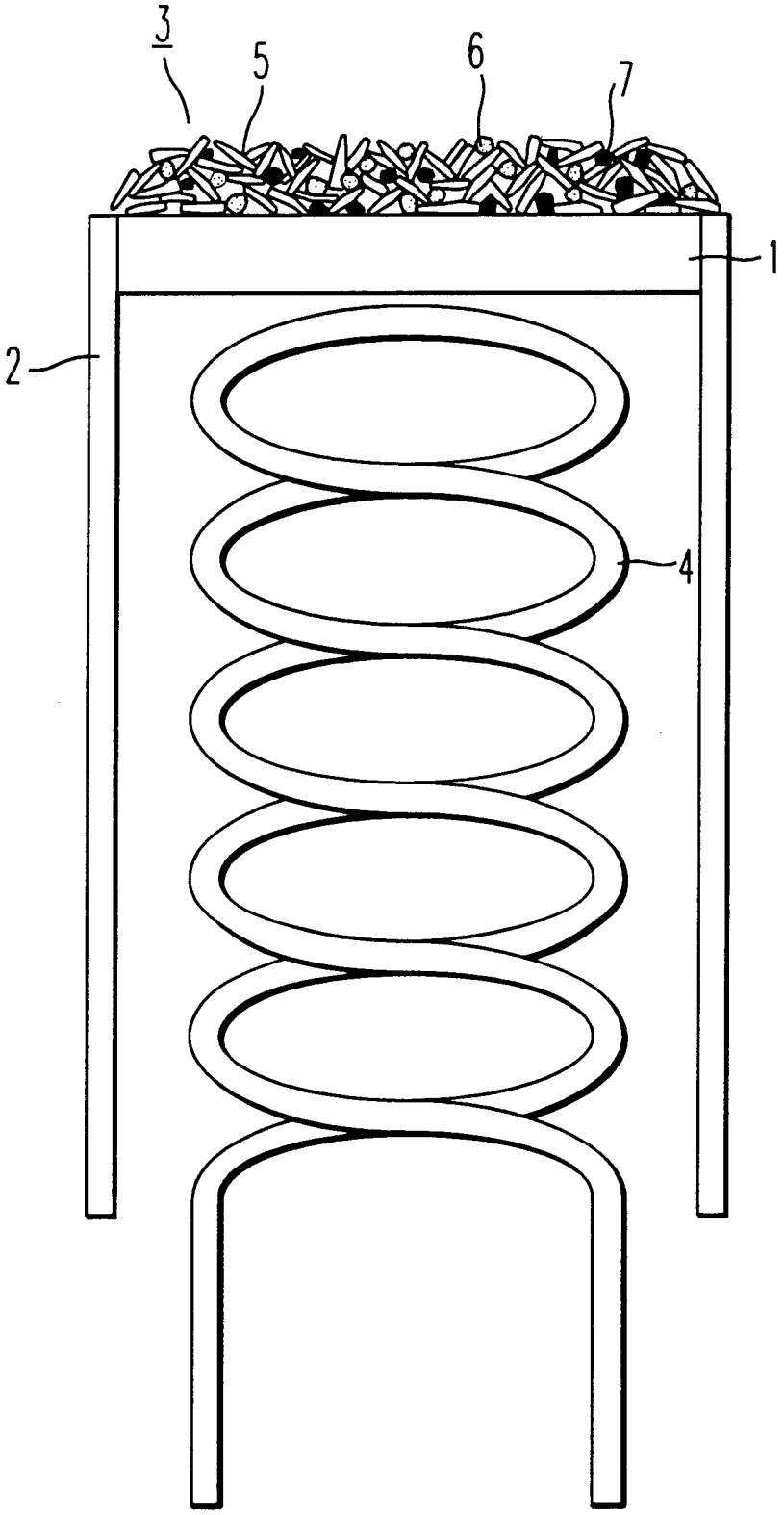

FIG. 8 is an enlarged cross sectional view of an oxide cathode of a cathode ray tube prepared in Example 3. FIG. 9 is a cross sectional view of the same cathode in the same position after a paste for printing is applied and dried which forms an electron emissive material layer in order to produce the cathode ray tube of FIG. 8. As is shown in FIG. 9, the layer 3 forming an electron emissive material layer mainly comprises particles 5 and 6 of alkaline metal carbonate and particles for producing voids 7. The alkaline earth metal carbonate comprises usual needle-like particles of particle 5 of the first group and particle 6 of the second group having shorter average length L and longer average diameter D than that of the particle of the first group. The present example corresponds to that particles for producing voids are added in the preparation of the cathode ray tube of Example 1. After completion of a cathode ray tube, the particles for producing voids 7 do not remain due to decomposition and evaporation, voids are formed in the position where the particles were present as is shown in FIG. 8. Also, overlap among each particle of the first group is further decreased in the presence of particles for producing voids 7 and particles 6 of the second group. Further, compared to Example 2, unevenness of an amount of electron emission becomes smaller and the amount of the electron emission is slightly increased. On the other hand, though there are numerous small holes on the surface, no large unevenness is seen, moire is hardly observed, and resolution is increased due to a shortened diameter of electron beam.

As mentioned above, electron emission property is improved when particles for producing voids and further, the second group particles as carbonate salt, are used more than when only one of them is used. The reason may be considered as follows: when two kinds of particles are used as carbonate salt, voids in electron emissive material layer become smaller compared to using of particles for producing voids. On the other hand, when the particles for producing voids are used, the structure of the electron emissive material layer is unstable to some extent after the particles for producing voids disappeared. If the spherical particles are present in the case, the structure of the electron emission layer becomes stable, and as a result, unevenness of an amount of electron emission becomes smaller which leads to increase of an amount of electron emission.

A process for preparing a cathode ray tube according to this Example is as follows. As particles of alkaline earth metal carbonate such as barium, strontium and calcium, two kinds of particles are used. The particles of the first group are needle-like particles having an average diameter 0.4 to 1.5 $\mu$m, an average diameter D of 0.4 to 15 $\mu$m. The particles of the second group are short and thick having an average length of at most 60% of that of the first group and an average diameter of at least 1.5 times larger than that of the first group. A paste for printing is made in the same manner as in Example 2 except for mixing the second particles of the alkaline earth metal carbonate so that particles of the first group is 50 to 95% by volume ratio against the alkaline earth metal carbonate, and the following process is also carried in the same manner as in Example 2 to prepare a cathode ray tube.

Example 4

In Examples 1 and 3, examples were shown in which an atomic ratio among barium, strontium and calcium was 0.5:0.4:0.1 in one case, equally for the particles of the two groups, and particles of the first group and the second group prepared separately are mixed in order that the first particles are 50 to 95% based on the atomic ratio of each alkaline earth metal carbonate. The ratio among barium, strontium and calcium is determined according to electron emission efficiency of the prepared cathode ray tube and the ratio is distributed to each group of the two particles.

In this example, the ratio of barium in the first and the second group is optimized while the total ratio among barium, strontium and calcium is kept. The particles of the second group comprise at least carbonate salt of barium and strontium, and an atomic ratio of the barium in the alkaline earth metal is at most 30%. As to the particles of the first group, the atomic ratio of the barium is 40 to 70%.

Figure 10:
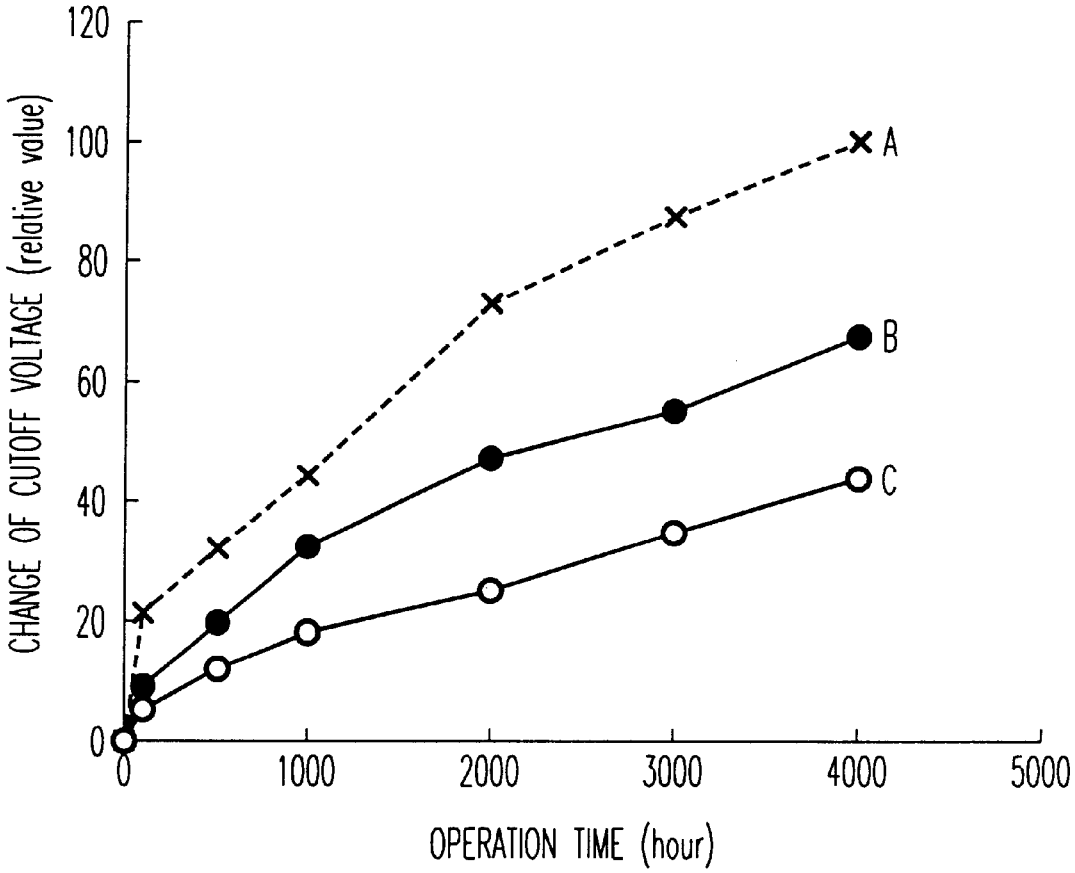
FIG. 10 is a diagrammatic view showing relationship between operation time and change of cut-off voltage of Example 4 of the present invention.

If the ratio of barium in the first group particles is not more than the minimum value, working function is increased and therefore, an amount of electron emission is clearly decreased. The particles of the second group have a small amount of electron emission originally, but it is considered that the total amount of the electron emission is hardly influenced even if the amount is further smaller. Also, as mentioned below, a phenomenon was seen in which barium was diffused to the surface of the second group particles from the surface of the first group particles. Differences were not seen substantially. On the other hand, in EXAMPLE 1, 2 or 3, there is a problem that brightness may change if operation condition of control power is fixed since cut-off voltage changes. FIG. 10 is a diagrammatic view showing relationship between operation time and change of cut-off voltage in Example 4. In Example 4, change of cut-off voltage through time becomes small. The reason is that sintering does not easily occur since barium in the particles of the second group is decreased. Therefore, it is considered that the structural change through time in electron emission layer become small and change of cut-off voltage through time also become small.

Example 5

In the above-mentioned EXAMPLES 1 to 4 the layer of the carbonate salt of alkaline earth metal was formed on the surface of the metal substrate 1 by a direct printing method. But in the present EXAMPLE the film comprising tungsten or molybdenum as a main component having 0.1 to 2 $\mu$m thickness is formed by means of an electron beam deposition, a printing method or the like before forming a layer of a carbonate salt of alkaline earth metal. Then, the film may be treated by heating at 900 to 1000° C. in hydrogen in order to reduce the oxide formed at film forming. The layer of a carbonate salt of alkaline earth metal is formed by using the metal substrate according to any example of the above-mentioned examples.

If a layer of carbonate salt of alkaline earth metal shown in EXAMPLES 1 to 4 is formed on the metal substrate 1 according to a screen printing, there may be a case that adhesiveness between the metal substrate 1 and the electron emissive material layer 3 is not sufficient due to a margin of process conditions. In this case, there arises a problem that an electron emissive material layer floats or peels off the metal substrate 1 during operating a negative cathode ray tube, cut-off voltage is drastically changed and an amount of electron emission is drastically decreased. In contrast this embodiment improves adhesive property and prevents from floating or peeling off to solve the cut-off voltage change. The reason is considered as follows: by forming the above-mentioned thin layer mainly comprising tungsten or molybdenum on the metal substrate, tungsten or molybdenum is mutually diffused with nickel composing the metal substrate thereby to form unevenness on the surface thereof. Paste for printing is incorporated into this unevenness by printing pressure to increase the adhesive property.

Material applied to the metal substrate may be tungsten or molybdenum as a main component. For instance, the material may contain several decades % of nickel, or may contain both tungsten and molybdenum.

In the above-mentioned Examples 2 to 5, examples by using a screen printing as an application method of printing paste are explained, the same effects are obtained by using the other printing methods as described in EXAMPLE 1.

Example 6

Figure 11:
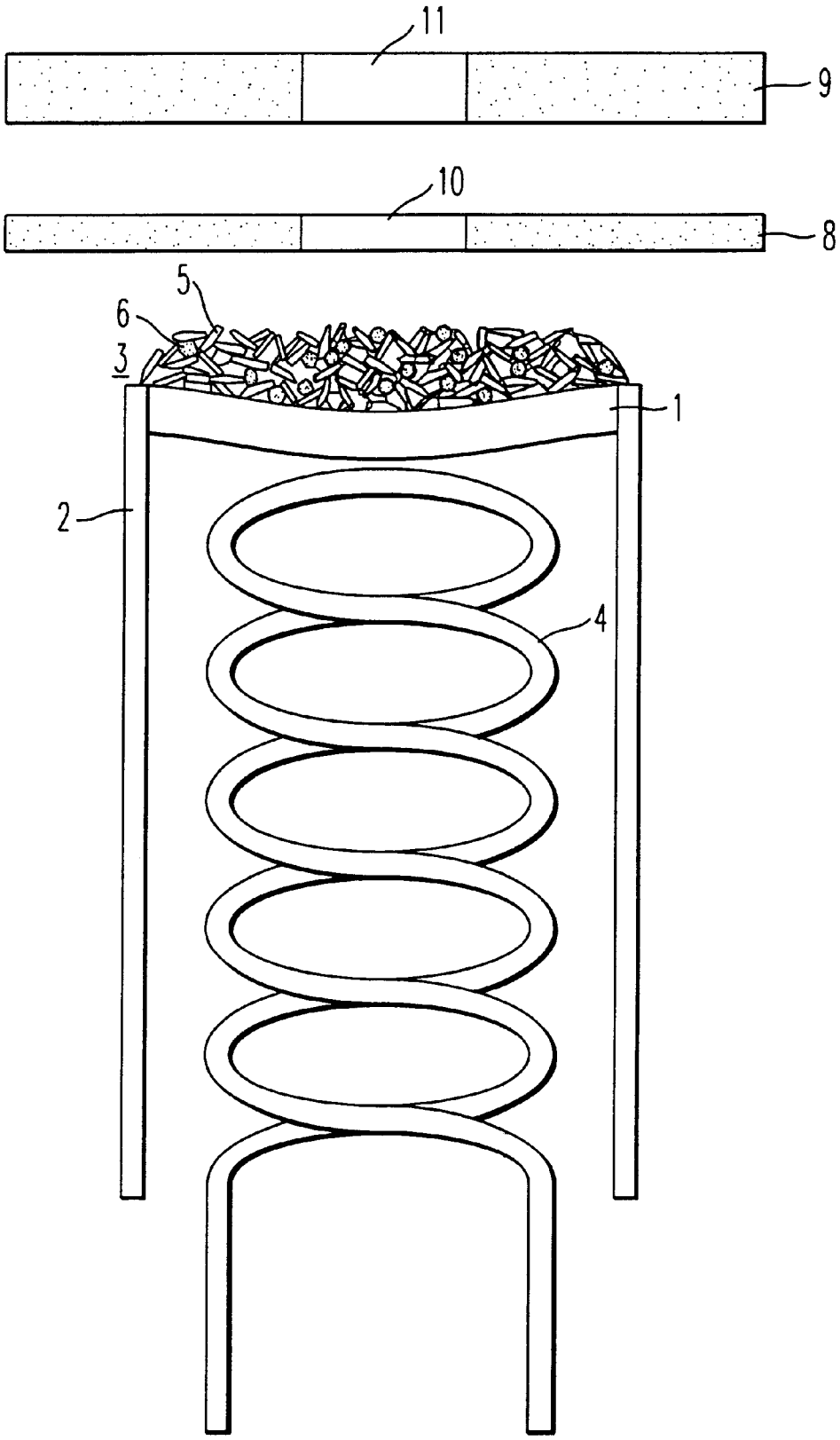
FIG. 11 is an enlarged cross sectional view of the oxide cathode of Example 6 of the present invention.

FIG. 11 is an enlarged cross sectional view of the oxide cathode of Example 6 of the present invention. In the above EXAMPLES 1 to 5 the surface constituting an electron emissive material layer 3 of a metal substrate is planar, but in the present EXAMPLE the surface is concave and the center part becomes depressed. As one example, the metal substrate is a disc having 15 mm of a metal substrate diameter, and the center part thereof is 0.3 mm lower than the peripheral part. Voltage distribution emitting electrons is formed in front of an electron emissive material layer 3. The first grid 8 and the second grid 9 are formed, which emit electrons from the electron passing holes 10 and 11 opened at the center part. Some grids forming electron beam, which are not described in the figure, are formed in front of these two grids. These grid constructions are not explained in EXAMPLES 1 to 5, but they are similarly constructed. As in FIG. 11, an electron emissive material layer 3 is thick at the center and thin at the peripheral, and the surface thereof is planer. Since a distance between the first grid 8 and the electron emissive material layer 3 at the electron passing hole 10 of the first grid determines an electric field emitting electrons, it has an effect on an amount of electron emission and thereby the horizontal position of the electron emissive material layer 3 and the second grid must be exactly adjusted if the surface of the electron emissive material layer 3 is not planar and convex at the center part. On the other hand, if the electron emissive material layer 3 is planar as in EXAMPLE 6, horizontal position of the electron emissive material layer 3 and the first grid may not be adjusted so exactly, if only vertical distance of the electron emissive material layer 3 and the first grid is exactly adjusted to cause the electric field emitting electrons constant. Therefore, a process becomes simple. In EXAMPLES 1 to 5, the surface of the electron emissive material layer 3 can be planar by raising viscosity of a printing paste. However, if the viscosity of a printing paste becomes high, defects on the printing surface tend to increase. On the other hand, if the viscosity becomes low, the center part tends to rise due to surface tension. In EXAMPLE 6, the surface of the electron emissive material layer 3 can become planar by depressing the center part of the metal substrate surface 1 even if the viscosity is low.

The condition, in which the electron emissive material layer becomes almost planar, is determined by a depth of the cavity of the metal substrate 1 (depth difference between the center part and the peripheral part) and the viscosity. For instance, if the depth of the cavity is large, the viscosity needs to be decreased and the conditions can be comparatively easily determined. However, if the viscosity is low, unevenness becomes large and it becomes difficult to control. Therefore, the viscosity is preferably at least 1000 cP, and the depth of the cavity needs to be at most 0.1 mm corresponding to the viscosity. And the thickness of the electron emissive material layer 3 needs to be thicker than the depth of the cavity. The depth of the cavity is not preferably over 0.15 mm (150 $\mu$m), since the depth of over 0.15 mm thickness corresponds to a thickness of the electron emissive material layer 3 of beyond 150 $\mu$m to start to decrease an amount of electron emission. And if the viscosity is large, a thickness of the center part of the electron emissive material layer does not become large compared with the peripheral part and there is no need to make the center of the metal substrate concave as mentioned-above. The upper limit thereof is about 6000 cP.

Raising the center part of the metal substrate more than the peripheral part prevents from a paste for printings' flowing horizontally or covering, and there is no need to adjust strictly horizontal position accuracy of a printing. The viscosity of the paste for printing has a little influence on the effect.

Shape of the cavity of the metal substrate 1 is preferably spherical against the former effect to make the surface of the electron emissive material layer planar. But shape has an effect, which has axis symmetry, is deep at the center part and becomes gradually shallow to the peripheral part. On the other hand, concerning the latter effect to prevent from the paste for printings' flowing horizontally or covering, the peripheral part preferably becomes high against the center part. And shape has a sufficient effect, which is almost planar from the center part to the peripheral part.

Example 7

Figure 12:
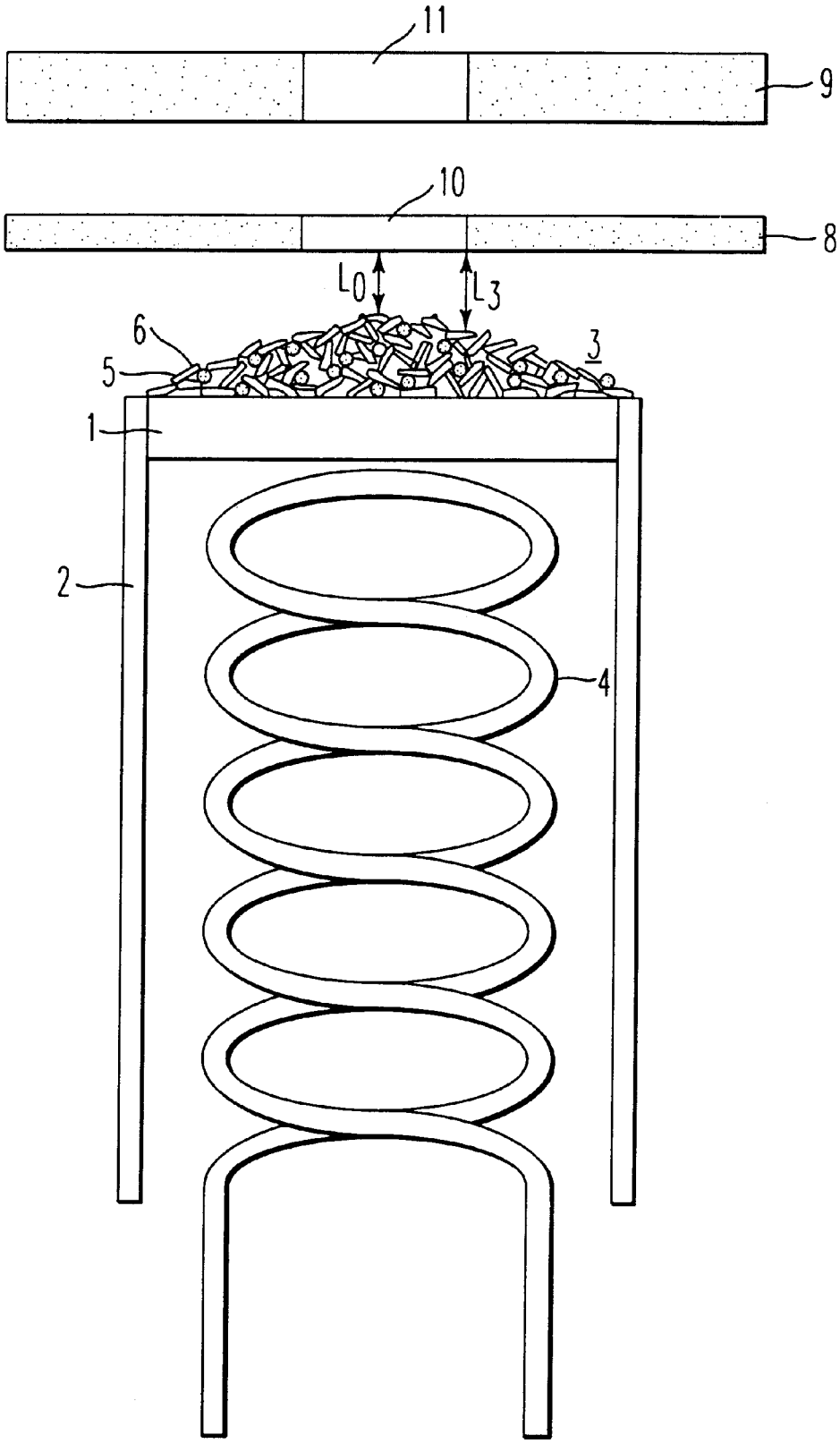
FIG. 12 is an enlarged cross sectional view of the oxide cathode of Example 7 of the present invention.

FIG. 12 is an enlarged cross sectional view of the oxide cathode of Example 7 of the present invention. The surface forming the electron emissive material layer 3 of the metal substrate 1 is planar, and the center part of the surface of the electron emissive material layer 3 is convex toward the electron passing hole 10 of the first grid 8. Thus, in order to make the surface of the electron emissive material layer 3 convex, a paste for printing is printed by lowering viscosity thereof, for instance, adjusting to 1000 to 6000 cP.

Since the surface emitting electrons is convex against electron passing hole 10 of the first grid 8, a diameter of electron beam becomes small to improve an image quality. Japanese Unexamined Patent Publication No.187528/1988 discloses that a diameter of electron beam becomes small if the surface emitting electrons is convex. The reason is roughly considered as follows. Namely, among electrons passing the electron passing hole 10, electrons emitted far from the center line of the electron passing hole 10 constitutes the peripheral part of the beam, the part is easily affected by an aberration of a lens and broadened. If the surface emitting electrons becomes convex, it becomes difficult to emit electrons since the position far from the center line has a farther distance between the surface emitting electrons and the first grid 8 than the part around the center line of the electron passing hole 10. Therefore, since a ratio of an amount of electron emission at the peripheral part decreases, which is a cause for broadening electron beam, a diameter of electron beam becomes small. And in Japanese Unexamined Patent Publication No. 187528/1988, it is necessary to process accurately the metal substrate convexly. In contrast to this, in EXAMPLE 7 of the present invention there is no need to process accurately the metal substrate convexly. And the convex surface emitting electrons can be formed only by adjusting printing conditions.

As shown in FIG. 12, with respect to a distance between surface of the first grid 8 and position emitting electrons, it is supposed that difference between distance L0 on the center line of the electron passing hole 10 and distance Ls at circumference of the electron passing hole 10 is dL(Ls−L0). An effect to decrease a diameter of electron beam is larger in the surface emitting electrons having high convexity (high dL). But even if dL is small, there is an effect, for instance, dL having about 0.01 mm decreases a few % of a beam diameter. As mentioned above, the center of the surface emitting electrons can become convex by decreasing viscosity of a paste for printing. If the viscosity is at most 6000 cP, the surface becomes convex. If the viscosity is at least 6000 cP, the surface becomes almost planar and not convex. If the viscosity becomes small, dL becomes large. But if the viscosity is at most 1000 cP, unevenness of shape becomes large. For instance, it is difficult to position the center of convexity in the center of the metal substrate, and to position the center of convexity in the center of the first grid.

If the center of the metal substrate as a center of convexity is not on the right position of the center of the first grid, distribution of beam is strained, moire easily occurs and a diameter of the beam becomes large. If difference between the center of the convexity and the center of the first grid is at most 20% of a diameter of the electron passing hole 10 in the first grid, the effect of decreasing a diameter of electron beam can be revealed. Thus, it is necessary to adjust accurately the horizontal mutual position of the electron emissive material layer and the electron emission hole 10 of the first grid. It is complicated, but it is possible to adjust the position optically.

Example 8

Figure 13:
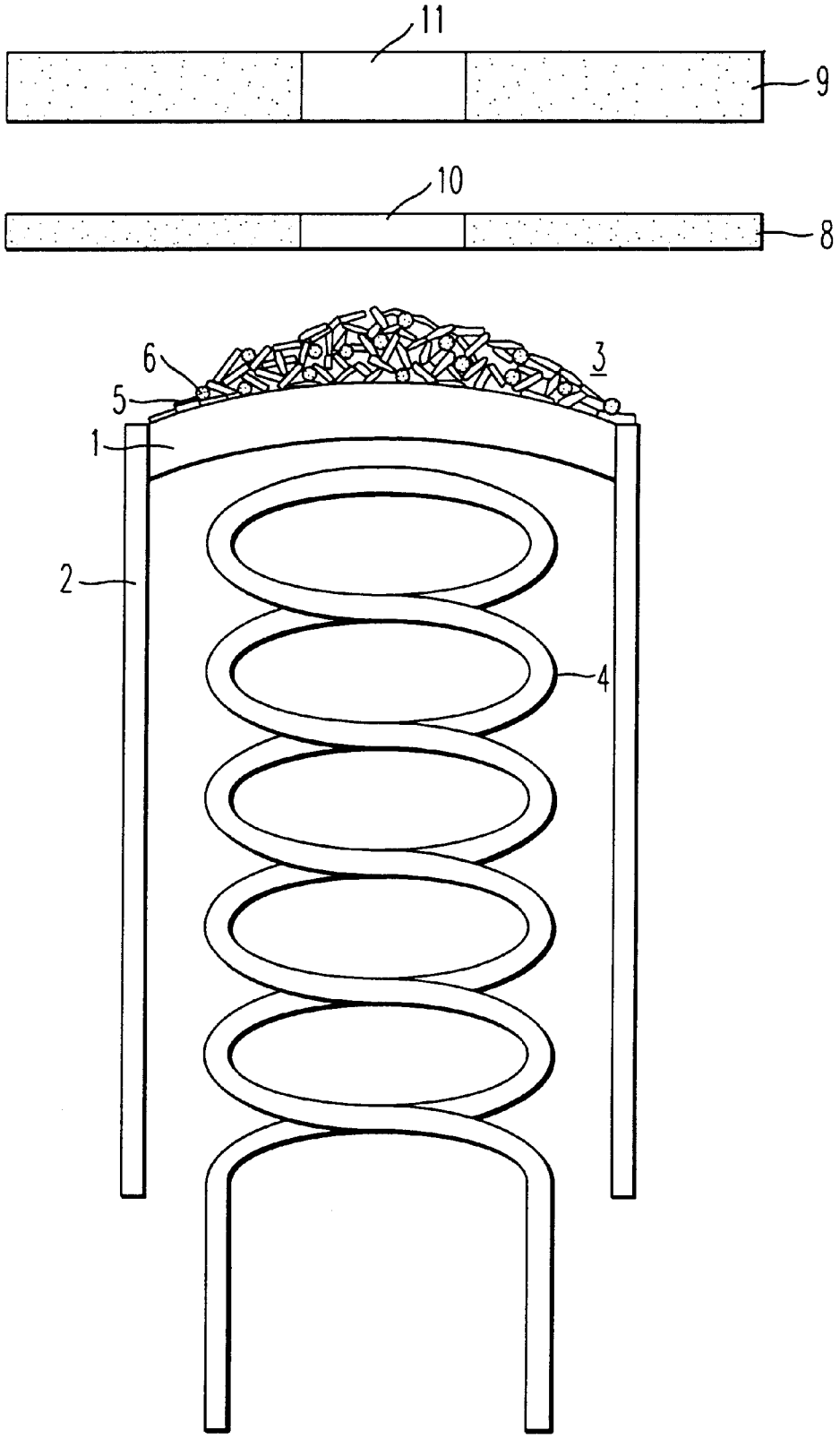
FIG. 13 is an enlarged cross sectional view of the oxide cathode of Example 8 of the present invention.

FIG. 13 is an enlarged cross sectional view of the oxide cathode of Example 8 of the present invention. The surface forming the electron emissive material layer 3 of the metal substrate 1 is processed as convexity, the electron emissive material layer 3 is thick at a center part and thin at a peripheral part. And the center part of the surface of the electron emissive material layer 3 is convex toward the electron passing hole 10 of the first grid 8. In order to make the metal substrate 1 convex, for instance, nickel plate containing a small amount of suitable components is punched out to obtain a disc-like plate. One of the punching tools may be made convex, the other thereof may be made concave. It is difficult to decrease unevenness, but it is possible by closely controlling punching conditions in consideration with unevenness of tools and abrasion conditions. On the other hand, the center part of the electron emissive material layer 3 can be thick by controlling conditions for printing, as in EXAMPLE 7. For example, a paste for printing is printed by lowering viscosity thereof, for instance, adjusting to 1000 to 6000 cP.

Since the surface emitting electrons is extremely convex against electron passing hole 10 of the first grid 8 (curvature is made more small), a diameter of electron beam becomes smaller than that in EXAMPLE 7 to improve an image quality. The smaller the curvature of convexity of the surface emitting electrons is, the smaller the diameter of the electron beam becomes and the more an image quality becomes. The reason is the same as the effect of convexity in EXAMPLE 7. It is considered that an electric field at the position far from the center line becomes small by decreasing a curvature of the convexity and that electron emission at the position far from the center line becomes small, which is a factor for increasing a diameter of the electron beam.

Thus, it is possible to decrease a curvature by making both the metal substrate 1 and the electron emissive material layer 3 convex. In case of decreasing a curvature only by the metal substrate 1, unevenness of the curvature becomes large with decreasing the curvature. Concerning the electron emissive material layer 3, there is a limit for increasing convexity only by printing conditions. Therefore, surface emitting electrons having a small curvature can be accurately formed by combining both of these.

Examples 1 to 13 and Comparative Examples 1 to 7

The present examples are the more concrete examples than that explained in EXAMPLE 1. Two particle groups are employed as particles of a carbonate of alkaline earth metal, which is an electron emissive material. Table 1 shows an average length L, an average diameter D thereof and a mixing ratio of these two particle groups (a ratio of the first group based on an atomic ratio of an alkaline earth metal). In all of these cases, alkaline earth metals comprise barium, strontium and calcium, and an atomic ratio thereof is 0.5:0.4:0.1. To the metals were added 3% by weight of scandium oxide particles based on the carbonate of alkaline earth metal. To 100 g of the powder mixture were added 3 to 5 g of a dispersion agent, 3.3 g of 5% nitrocellulose solution in a butyl acetate solvent, 40 to 60 g of terpineol. With stirring viscosity was controlled to about 400 cP by mainly adjusting amounts of the dispersion agent and terpineol to obtain a paste for printing.

Metal substrate comprises nickel as a main component, 0.08% by weight of silicon, and 0.04% by weight of magnesium. A diameter r1 thereof is 1.6 mm and a thickness is 80 $\mu$m. Mesh of printing screen is No.250, and an opening diameter of the mask r2 is 14 mm. After printing, the substrate was dried in an air at 110° C. for 30 minutes to obtain the layer forming electron emissive material having a thickness of about 80 $\mu$m. After that, the oxide cathode was incorporated to a color television picture tube having 17 inches size for monitoring as a cathode ray tube. After the pre-determined processes, an amount of electron emission, moire and a diameter of electron beam were measured. The results thereof are shown in Table 1.

Since electron emission property can not be precisely evaluated under white indication as the severest condition, the electron emission property was evaluated from a decreasing amount of electron emission by decreasing induced voltage of filament 4 to decrease a temperature of the electron emissive material layer in a state of indicating white. If the induced voltage of filament decreases from the standard value, an amount of the electron emission does not change at first, but the amount thereof suddenly decreases at the particular induced voltage. In Table 1, a ratio P of the filament induced voltage at 70% of an amount of electron emission to the filament induced voltage (standard value) under the usual running condition is regarded as an evaluation value of an amount of electron emission. The smaller the value is, the more excellent the property is. The ratio P shows a margin of an amount of electron emission of the oxide cathode. For example, the duration can be estimated by using the ratio, and electron emission property is reflected. Moire is evaluated by visible observation compared with the same indication expressed by the same television picture tube having 17 inches size for monitoring with a conventional cathode. Table 1 shows the results. ⊙ is excellent, ○ is good, and Δ is the same level. Concerning a beam diameter, a point was indicated, and brightness distribution was measured with slightly titling the position according to an electric current sent into a deflection yoke to obtain an electron beam distribution. A half bandwidth of the electron beam distribution was compared with the above television picture tube with a conventional cathode, and ratios were shown as a beam diameter in Table 1. The smaller the value is, the more excellent the property is.

From the results of Table 1 especially in EXAMPLES 1 to 5 and COMPARATIVE EXAMPLES 1 to 4, it can be seen that if a particle ratio of the first group of carbonate salt is 50 to 90%, an amount of electron emission is as much as that in COMPARATIVE EXAMPLES, and both moire and a diameter of electron beam are improved. Compared with a mixing ratio of the second particle group, if a particle ratio of the first group, which is easy to emit electrons, is small, an amount of electron emission becomes small (the value becomes large). If the ratio is large, the amount of electron emission becomes slightly small and unevenness thereof becomes large since voids in an electron emissive material layer decrease.

From the results in EXAMPLES 6 to 8 or EXAMPLES 9 to 11 and COMPARATIVE EXAMPLE 5, it can be seen that if a diameter D of the second group particle is small, voids in an electron emissive material layer decrease, an amount of electron emission becomes small, and the diameter D of the second group particle needs to be at least 1.5 times larger than that of the first group particle. And from the results in EXAMPLES 6 to 8 and COMPARATIVE EXAMPLE 6, it can be seen that if a length L of the second group particle is close to the length L of the first group particle, voids in an electron emissive material layer decrease, an amount of electron emission becomes small, and the length L of the second group particle needs to be at most 60% of that of the first group particle. By a scanning electron microscope a state was observed, wherein voids decreased in an electron emissive material layer in case that the diameter D of the second group was small and that the length L thereof was large. And a state was also observed, wherein voids in an electron emissive material layer were slightly overlapped in case that a ratio of the first group particle was large.

TABLE 1

| No. | Ratio of the first group particles (%) | First group L (μm) | First group D (μm) | Second group L (μm) | Second group D (μm) | Amount of electron emission: margin (%) | Moire | Diameter of electron beam (%) |
|---|---|---|---|---|---|---|---|---|
| Ex. 1 | 95 | 5 | 0.7 | 2.0 | 1.9 | 68 ± 4 | ◎ | 75 |
| Ex. 2 | 90 | 5 | 0.7 | 2.0 | 1.9 | 67 ± 4 | ◎ | 80 |
| Ex. 3 | 75 | 5 | 0.7 | 2.0 | 1.9 | 66 ± 3 | ◎ | 80 |
| Ex. 4 | 65 | 5 | 0.7 | 2.0 | 1.9 | 67 ± 3 | ◎ | 85 |
| Ex. 5 | 50 | 5 | 0.7 | 2.0 | 1.9 | 69 ± 3 | ◎ | 85 |
| Ex. 6 | 95 | 5 | 0.7 | 2.0 | 1.05 | 70 ± 4 | ◎ | 75 |
| Ex. 7 | 75 | 5 | 0.7 | 3.0 | 1.05 | 68 ± 3 | ◎ | 80 |
| Ex. 8 | 50 | 5 | 0.7 | 3.0 | 1.05 | 71 ± 3 | ◎ | 80 |
| Ex. 9 | 95 | 5 | 0.7 | 1.2 | 1.1 | 69 ± 5 | ◎ | 75 |
| Ex. 10 | 75 | 5 | 0.7 | 1.2 | 1.1 | 67 ± 3 | ◎ | 80 |
| Ex. 11 | 50 | 5 | 0.7 | 1.2 | 1.1 | 69 ± 3 | ◎ | 80 |
| Ex. 12 | 75 | 8 | 0.9 | 3.8 | 3.2 | 67 ± 3 | ◎ | 80 |
| Ex. 13 | 75 | 5 | 1.2 | 7.5 | 7.0 | 67 ± 4 | ◎ | 85 |
| Com. Ex. 1 | 100 | 5 | 0.7 | — | — | 76 ± 6 | ◎ | 75 |
| Com. Ex. 2 | 97 | 5 | 0.7 | 2.0 | 1.9 | 70 ± 7 | ◎ | 80 |
| Com. Ex. 3 | 30 | 5 | 0.7 | 2.0 | 1.9 | 77 ± 5 | ◎ | 80 |
| Com. Ex. 4 | 0 | — | — | 2.0 | 1.9 | 84 ± 4 | — | — |
| Com. Ex. 5 | 75 | 5 | 0.7 | 2.0 | 0.8 | 76 ± 5 | ◎ | 80 |
| Com. Ex. 6 | 75 | 5 | 0.7 | 3.8 | 3.2 | 72 ± 6 | ◎ | 80 |
| Com. Ex. 7 | 75 | 4 | 1.2 | 8.5 | 8.2 | 67 ± 5 | ○ | 90 |
| Conventional Ex. | 100 | 5 | 0.7 | — | — | 66 ± 3 | Δ | 100 |

From EXAMPLES 12 to 13 and COMPARATIVE EXAMPLE 7, it can be seen that if a diameter D of the second group particle becomes large, a mark of the second group particle emitting less electrons is formed, an electron emission distribution becomes uneven, moire easily occurs, and a diameter of electron beam becomes large. Therefore, a diameter of the second group particle needs to be at most 7 μm. Relation between the second group particles and unevenness of electron beam was confirmed by consistence with a distribution of electron beam on the cathode surface and a surface distribution of the second group particle observed by a scanning electron microscope. But even if a diameter of the second group particle is beyond most 7 μm, moire and a diameter of electron beam is more excellent than those in COMPARATIVE EXAMPLE, and effects of the present invention were confirmed.

Examples 14 to 24 and Comparative Examples 8 to 12

The present examples are the more concrete examples than that explained in EXAMPLE 2. Carbonate of an alkaline earth metal, which becomes an electron emissive material, comprises barium, strontium and calcium as an alkaline earth metal, an atomic ratio thereof is 0.5:0.4:0.1, and it is a needle-like particle having an average length L of 5 μm and an average diameter D of 0.7 μm. To the carbonate was added 3% by weight of scandium oxide powder based on the carbonate of the alkaline earth metal. To the powder mixture was added an acrylic resin powder, poly(methyl methacrylate), having a spherical shape and an average diameter D shown in Table 2 as a void particle in a volume ratio shown in Table 2 based on the carbonate of alkaline earth metal. In only EXAMPLE 24, a void particle is almost cylindrical and has an average diameter D of 3 μm and an average length L of 15 μm. To 100 g of the powder mixture were added 3 to 5 g of a dispersion agent, 3.0 g of 5% nitrocellulose solution in a butyl acetate solvent, 40 to 60 g of terpineol. With stirring viscosity was controlled to about 5000 cP by mainly adjusting amounts of the dispersion agent and terpineol to obtain a paste for printing.

In only COMPARATIVE EXAMPLE 12, an electron emissive material layer was formed by a spraying method not a printing method. The paste was suitable for a spraying method and different from the above-mentioned method.

Metal substrate, a screen for printing, and a mask were the same as in EXAMPLE 1. After printing, the substrate was dried in an air at 110° C. for 30 minutes to obtain the layer forming electron emissive material having a thickness of about 80 μm. In the above-mentioned paste process to the drying process, particles for producing voids were kept as they were. The oxide cathode having no problems in this process was incorporated into a color television picture tube having 17 inches size for monitoring as a cathode ray tube. After the cathode was firstly heated to 380° C. by a furnace with being drown to a vacuum by a diffusion pump, the part around the cathode (at the part of an electron gun) was heated by an electromagnetic induction to keep a temperature of the cathode at about 500° C. for 30 minutes. In this process particles for voids were evaporated completely. Thereafter, a temperature of only the cathode was raised by a conduction of a filament, carbonate of alkaline earth metal was decomposed to oxides according to the pre-determined temperature pattern having the maximum temperature of about 1000° C. to complete the layer of electron emissive material layer. After the other pre-determined processes, an amount of electron emission, moire and a diameter of electron beam were measured. The results thereof are shown in Table 2.

TABLE 2

| No. | Ratio of particles for voids material (% by volume) | Diameter of particles for voids material (D μm) | Amount of electron emission: margin (%) | Moire | Diameter of electron beam (%) |
|---|---|---|---|---|---|
| Ex. 14 | 5 | 5 (spherical) | 68 ± 4 | ◎ | 75 |
| Ex. 15 | 10 | 5 (spherical) | 66 ± 3 | ◎ | 80 |
| Ex. 16 | 20 | 5 (spherical) | 65 ± 4 | ◎ | 80 |
| Ex. 17 | 30 | 5 (spherical) | 65 ± 5 | ◎ | 85 |
| Ex. 18 | 5 | 1 (spherical) | 70 ± 4 | ◎ | 75 |
| Ex. 19 | 20 | 1 (spherical) | 68 ± 3 | ◎ | 80 |
| Ex. 20 | 30 | 1 (spherical) | 69 ± 4 | ◎ | 80 |
| Ex. 21 | 5 | 20 (spherical) | 69 ± 4 | ◎ | 80 |
| Ex. 22 | 20 | 20 (spherical) | 66 ± 3 | ◎ | 85 |
| Ex. 23 | 30 | 20 (spherical) | 67 ± 5 | ◎ | 90 |
| Ex. 24 | 20 | 3 × 15 (cylindrical) | 66 ± 3 | ◎ | 80 |
| Com. Ex. 8 | 3 | 5 (spherical) | 74 ± 5 | ◎ | 75 |
| Com. Ex. 9 | 40 | 5 (spherical) | 70 ± 7 | ◎ | 80 |
| Com. Ex. 10 | 20 | 0.5 (spherical) | 75 ± 5 | ◎ | 80 |
| Com. Ex. 11 | 20 | 25 (spherical) | 67 ± 4 | Δ–○ | 95 |
| Com. Ex. 12 | 10 | 2 (spherical) | 68 ± 7 | Δ | 105 |

(1) Cylindrical voids material is used in EXAMPLE 24.
(2) COMPARATIVE EXAMPLE 12 is made by spraying.

From the results of Table 2 especially in EXAMPLES 14 to 17 and COMPARATIVE EXAMPLES 8 to 9, it can be seen that if a particle ratio of particles for producing voids is 5 to 30% by volume, an amount of electron emission is as much as that in Conventional Examples, and both moire and a diameter of electron beam are improved. If the particle ratio thereof is small than that range, an amount of electron emission becomes small. If the ratio is large, the amount of electron emission becomes slightly small and unevenness thereof becomes high.

From the results in EXAMPLES 18 to 23 and COMPARATIVE EXAMPLES 10 to 11, it can be seen that if an average diameter D of the particles for the voids material is small, a size of the voids decrease, an amount of electron emission becomes small. If the average diameter D is large, distribution of electron beam becomes uneven corresponding to the part wherein the particle for voids material come out, there may be a case that moire occurs as much as in Conventional Example, and a diameter of electron beam can not be so small. From these EXAMPLES, it can be seen that an average diameter D of the particle for voids material may be 1 to 20 μm. A surface state of these electron emissive materials and distribution of electron beam are confirmed by a scanning electron microscope and a device for measurement of electron beam distribution.

EXAMPLE 24 is an example using cylindrical particles for producing voids, it shows almost the same property obtained in employing spherical particles for producing voids. Therefore, it can been seen that the particles for producing voids, which are not spherical, have the same effects.

From COMPARATIVE EXAMPLES 12, it can been seen that if the paste contains particles for producing voids and a spraying method is used, unevenness of electron emission property becomes large. From the results of duration experiments, there may be a case that a cut-off voltage drastically changes. These are caused by the following reason. If particles for producing voids and a spraying method are combined, a structure of an electron emissive material layer becomes unstable.

Examples 25 to 34

The present examples are the more concrete examples than that explained in EXAMPLE 3. As particles of carbonate of an alkaline earth metal, which becomes an electron emissive material, two groups particles are employed. The first group is a needle-like particle having an average length of 5 μm and an average diameter of 0.7 μm. A size of the second group particle and a mixing ratio of these two group particles are shown in Table 3. Both of these particles comprise barium, strontium and calcium as an alkaline earth metal, an atomic ratio thereof is 0.5:0.4:0.1. To the carbonates was added 3% by weight of scandium oxide powder based on the carbonate of alkaline earth metal. To the powder mixture was added an acrylic resin powder, poly (methyl methacrylate), having a spherical shape and an average diameter D shown in Table 3 as a void particle in a volume ratio shown in Table 3 based on the carbonate of alkaline earth metal. In EXAMPLE 35, scandium oxide was not added. To 100 g of the powder mixture were added 3 to 5 g of a dispersion agent, 3.5 g of 5% nitrocellulose solution in butyl acetate solvent, 40 to 60 g of terpineol. With stirring viscosity was controlled to about 5500 cP by mainly adjusting amounts of the dispersion agent and terpineol to obtain a paste for printing. Metal substrate, a screen for printing, and a mask were the same as in EXAMPLES 1 to 24, the processes thereafter was the same as in EXAMPLES 1 to 24. By using the completed color television picture tube having 17 inches size for monitoring, an amount of electron emission, moire and a diameter of electron beam were measured. The results thereof are shown in Table 3.

TABLE 3

| No. | Ratio of the first group particles (%) | Second group L (μm) | Second group D (μm) | Ratio D of particles for voids material (%) | Ratio D of particles for voids material (μm) | Sc amount (%) | Amount of electron emission: margin(%) | Moire | Diameter of electron beam (%) |
|---|---|---|---|---|---|---|---|---|---|
| Ex. 25 | 95 | 2.0 | 1.9 | 20 | 5 | 3 | 65 ± 3 | ◎ | 75 |
| Ex. 26 | 75 | 2.0 | 1.9 | 20 | 5 | 3 | 62 ± 2 | ◎ | 80 |
| Ex. 27 | 50 | 2.0 | 1.9 | 20 | 5 | 3 | 65 ± 2 | ◎ | 80 |
| Ex. 28 | 75 | 3.0 | 1.05 | 20 | 5 | 3 | 64 ± 2 | ◎ | 80 |

TABLE 3-continued

| No. | Ratio of the first group particles (%) | Second group L (μm) | Second group D (μm) | Ratio D of particles for voids material (%) | Ratio D of particles for voids material (μm) | Sc amount (%) | Amount of electron emission: margin(%) | Moire | Diameter of electron beam (%) |
|---|---|---|---|---|---|---|---|---|---|
| Ex. 29 | 75 | 1.2 | 1.1 | 20 | 5 | 3 | 63 ± 5 | ⊙ | 80 |
| Ex. 30 | 95 | 2.0 | 1.9 | 5 | 5 | 3 | 65 ± 3 | ⊙ | 80 |
| Ex. 31 | 75 | 2.0 | 1.9 | 10 | 5 | 3 | 64 ± 2 | ⊙ | 80 |
| Ex. 32 | 50 | 2.0 | 1.9 | 30 | 5 | 3 | 66 ± 3 | ⊙ | 80 |
| Ex. 33 | 75 | 8 | 1.9 | 20 | 1 | 3 | 64 ± 2 | ⊙ | 80 |
| Ex. 34 | 75 | 5 | 1.9 | 20 | 20 | 3 | 64 ± 3 | ⊙ | 85 |
| Ex. 35 | 75 | 2.0 | 1.9 | 20 | 5 | 0 | 63 ± 2 | ⊙ | 80 |

From Table 3, it can be seen that by using particles for producing voids and the second group particles an amount of electron emission is the same or more than that in COMPARATIVE EXAMPLES shown in Table 1. Compared with EXAMPLES 1 to 24, wherein the particles for producing voids or the second particle group are not employed, it can be also seen that an amount of electron emission slightly increases totally and especially unevenness thereof becomes small. And in EXAMPLE 35 employing no scandium oxide, the same effect is obtained. It is separately confirmed that the particles having scandium oxide improve duration property.

Examples 36 to 37

The present examples are the more concrete examples than that explained in EXAMPLE 4. As particles of carbonate of an alkaline earth metal, which becomes an electron emissive material, two groups particles are employed. The first group is a needle-like particle having an average length of 5 μm and an average diameter of 0.7 μm. The second group is a spherical particle having an average diameter D of about 2 μm in EXAMPLES 26 to 37. A ratio of the first group particle in carbonate of an alkaline earth metal is 75% based on an atomic ratio of an alkaline earth metal. In both of these groups alkaline earth metals comprise barium, strontium and calcium, an atomic ratio of the first group particle is 0.5:0.4:0.1, an atomic ratio of the second group particle is 0.3:0.6:0.1 in EXAMPLE 36 and 0.15:0.75:0.1 in EXAMPLE 37. To the carbonate was added 3% by weight of scandium oxide powder based on the carbonate of alkaline earth metal. To the powder mixture was added an acrylic resin powder, poly(methyl methacrylate), having a spherical shape and an average diameter of 5 μm as a void particle in an amount of 20% by volume based on the carbonate of alkaline earth metal. The above-mentioned method is the same as in EXAMPLE 26 except for a composition ratio of the second particle group and the other methods and processes are the same as in EXAMPLE 26. After completion of the color television picture tube having 17 inches size for monitoring, an amount of electron emission, moire and a diameter of electron beam were measured. The results thereof are shown in Table 4.

TABLE 4

| No. | Ratio of the first group particles (%) | Second group L (μm) | Second group D (μm) | Amount of electron emission: margin (%) | Moire | Diameter of electron beam (%) |
|---|---|---|---|---|---|---|
| Ex. 36 | 30 | 0 | — | 63 ± 3 | ⊙ | 80 |
| Ex. 37 | 15 | 0 | — | 65 ± 2 | ⊙ | 85 |
| Reference (Ex. 27) | 50 | 0 | — | 62 ± 2 | ⊙ | 80 |
| Ex. 38 | 50 | 0.4 | ϕ1.3 | 61 ± 2 | ⊙ | 80 |
| Ex. 39 | 50 | 0.9 | ϕ1.3 | 62 ± 2 | ⊙ | 80 |
| Ex. 40 | 50 | 0.9 | ϕ0.3 × 7 | 61 ± 2 | ⊙ | 80 |
| Ex. 41 | 50 | 0.4 (Mo) | ϕ1.3 | 62 ± 2 | ⊙ | 80 |

From Table 4, it can be seen that an amount of electron emission is slightly more excellent in EXAMPLE 26 but in all EXAMPLES an amount of electron emission is the same level, znd both moire and a diameter of electron beam are more excellent than in COMPARATIVE EXAMPLES (Table 1). Duration experiments of EXAMPLES 26, 36 and 37 were carried out. Change of a cut-off voltage in this case is shown in FIG. 10. In this figure EXAMPLE 26, 36 and 37 respectively denote A, B and C. From this figure it can be seen that if a ratio of barium in the second group particle is at most 30%, change of a cut-off voltage can be decreased. After the duration experiment the surface was observed by a scanning electron microscopy, it was confirmed that sintering in EXAMPLES 36 and 37 was not promoted compared with that in EXAMPLE 26.

The cathode produced by the same method as in EXAMPLE 37 was put in Auger analyzer, composition change on the surface of the second group particle was investigated with operating at about 750° C. after a carbonate of an alkaline earth metal was decomposed to an oxide by heating in a vacuum. It can be seen that an amount of barium increased to a ratio close to the first group particle after about one hour. From these results, since the second group particle has a small amount of electron emission and a surface amount of barium diffused from the first group particle increases, an amount of electron emission in EXAMPLES 36 and 37 may be the same level as in EXAMPLE 26. After operating the cathode in Auger analyzer for about additional 100 hours, the composition was measured by surface etching of argon ion to understand that an amount of barium did not increase so much inside.

Therefore, it can be thought that deformation of sintering was controlled by the part containing less barium except for the surface.

Examples 38 to 41

The present examples are the more concrete examples than that explained in EXAMPLE 5. Metal substrate 1 was employed, which comprised nickel as a main component, 0.08% by weight of silicon, and 0.04% by weight of magnesium, and had a diameter r1 of 1.6 mm and a thickness of 80 μm. In EXAMPLE 38 tungsten film having 0.4 μm thickness was formed on the center surface having a diameter of 1.3 mm. In EXAMPLE 39 tungsten film having 0.9 μm thickness was formed on the center surface of the metal substrate having a diameter of 1.3 mm. In EXAMPLE 40, seven circular patterns having a diameter of 0.3 mm, which were made of tungsten film having a thickness of 0.9 μm, were arranged on the surface of the metal substrate in such a way that one pattern at the center was surrounded by the other six patterns with a pitch of 0.4 mm. In EXAMPLE 41, a molybdenum film having 0.4 mm thickness was formed on the center surface of the metal substrate having a diameter of 1.3 mm. All films were formed by an electron beam deposition. In EXAMPLES 38 to 41 a paste for printing and preparation processes thereafter are the same as in COMPARATIVE EXAMPLE 26.

Electron emission property, moire and a diameter of electron beam of the cathode ray tube shown in Table 4 were the same level as in EXAMPLE 26 to find that there was no significant difference.

On the other hand, in the present invention as EXAMPLE 26 having no tungsten deposition on the metal substrate, there was a case that a cut-off voltage drastically changed in a ratio of a few % during duration experiment as they were, and an amount of electron emission also decreased. By observing the surface of the cathode, wherein the phenomena occurred, it was seen that an electron emissive material layer left the metal substrate, floated and peeled off. Therefore, after printing and drying, all cathodes were tested by an adhesion test blowing a constant amount of air to employ only the cathodes in which the electron emissive material layer did not peel off. Though there was no cathode wherein an electron emissive material layer floated and a cut-off voltage drastically changed during the above duration experiment, there was problems that the adhesion test needed to be carried out and about 10% of inferior goods were produced after a drying process. On the other hand, in EXAMPLE 38 few cathodes peeled off in the adhesion test. Therefore, only the random sampling at each rod is sufficient for an examination. It can be seen that there is no need for the adhesion test by optimizing conditions and a ratio of inferior goods becomes small more.

The reason why the adhesion property is improved in this example is thought that the surface of the metal substrate becomes uneven by the mutual diffusion of tungsten or molybdenum and nickel and a printed electron emissive material layer is incorporated in the unevenness to improve the adhesion property. In fact, this cathode was incorporated into the resin, a section was taken out by shaving and the surface thereof was observed by a scanning electron microscopy to confirm the effect by finding out that there was unevenness of the metal substrate and an electron emissive material layer was incorporated therein.

The cathode ray tube having the oxide cathode of the present invention comprises an electron emissive material layer having an alkaline earth metal oxide on a metal substrate containing nickel as a major component, wherein the alkaline earth metal oxide comprises a mixture of needle-like particles of the first group and bulk particles of the second group which are different from the particles of the first group. An average length of the particles of the second group is at most 60% of that of the first group particles, an average diameter of the particles of the second group is at least 1.5 times larger than that of the first group particles and a ratio of the particles of the first group in the alkaline earth metal oxide constituting the electron emissive material layer is 50 to 95% based on the atomic ratio of the alkaline earth metal oxide. Therefore, the crystalline particles of the alkaline earth metal oxide are randomly accumulated to form voids in the electron emission layer and a sufficient amount of electron emission can be obtained. The layer forming an electron emissive material layer of a cathode was formed by printing, and large unevenness on the surface disappeared. Therefore, distribution of electron emission became uniform to restrain moire from occurring, and a cathode ray tube having a shortened electron beam diameter and a high resolution is prepared.

Since the particles of the second group are spherical particles having an average diameter of at most 7 μm, trace of the particles of the second group having a little electron emission does not appear on the electron beam distribution, and moire is restrained from occurring and the electron beam diameter can be shortened.

Since the particles of the second group comprise at least carbonate salts of barium and strontium and a total amount of the barium in the particles of the second group is at most 30% in an atomic ratio based on the total amount of the alkaline earth metal of the particles of the second group, deforming during preparation process is reduced and thereby change of cut-off voltage can be decreased.

Base on which an electron emissive material layer of a metal substrate is formed is a nearly circular shape having a diameter of r1 (mm) and planar shape of the electron emissive material layer is nearly circular shape having a diameter of r2 (mm), and the following equation is satisfied.

$$r2 \leqq r1 - 0.1$$

Therefore, whole shape of the electron emissive material can be controlled, thickness can become uniform and unevenness of properties can become smaller.

Further, since a layer containing, as a main component, tungsten or molybdenum is prepared between the metal substrate and the electron emissive material layer, adhesion between the metal substrate and the electron emissive material layer is improved, and therefore, change of cut-off voltage can be decreased and duration property can be improved.

The first process for preparing the oxide cathode of the cathode ray tube of the present invention comprises a process for applying, by printing, the paste for printing containing particles of the alkaline earth metal carbonate forming the electron emissive material on the metal substrate which contains nickel as a main component and constitutes the oxide cathode, a drying process in which the paste for printing applied in the above process is fixed on the metal substrate, and a process for heating during forming a vacuum to oxidize the alkaline earth metal carbonate to an oxide as the electron emissive material after the oxide cathode is incorporated in the cathode ray tube, wherein as the alkaline earth metal carbonate, there is used a mixture of needle-like particles of the first group and bulk particles of the second group which is different from the particles of the first group, an average length of the particles of the second group is at most 60% of that of the first group particles, an average diameter of the particles of the second group particle is at least 1.5 times larger than that of the first group particle, and a ratio of the particles of the first group in the alkaline earth metal oxide constituting the electron emissive material layer is 50 to 95% based on the atomic ratio of the alkaline earth metal oxide. Therefore, large unevenness on the surface has disappeared, distribution of electron emission becomes uniform to restrain moire from occurring, and a cathode ray tube having a shortened electron beam diameter and a high resolution is prepared. Further, the crystalline particles of the alkaline earth metal oxide are randomly accumulated to form voids in the electron emission layer and a sufficient amount of electron emission can be obtained.

The second process for preparing the oxide cathode of the cathode ray tube of the present invention comprises a process for applying, by printing, the paste for printing containing particles of the alkaline earth metal carbonate forming the electron emissive material and particles for producing voids having an average diameter of 1 to 20 $\mu$m on the metal substrate which contains nickel as a main component and constitutes the oxide cathode, a drying process in which the paste for printing applied in the above process is fixed on the metal substrate, and a process for heating during forming a vacuum to oxidize the alkaline earth metal carbonate to an oxide as the electron emissive material after the oxide cathode is incorporated in the cathode ray tube and a process in which the above particles for producing voids are removed while heating. Therefore, voids are formed at the position where the particles for producing voids in the electron emissive material layer are evaporated, a sufficient amount of electron emission can be obtained.

Since a volume ratio of the particles for producing voids against the alkaline earth metal carbonate is 5 to 30%, a sufficient amount of electron emission can be obtained and unevenness thereof can be restrained.

Since the particles for producing voids is acrylic resin powder, the shape is kept until the drying process securely finishes and it is completely evaporated before a temperature becomes 600° C., and therefore, efficient voids are formed in the electron emissive material layer.

As the alkaline earth metal carbonate in the paste for printing, there is used a mixture of needle-like particles of the first group and bulk particles of the second group which is different from the particles of the first group. An average length of the particles of the second group is at most 60% of that of the first group, an average diameter of the particles of the second group is at least 1.5 times larger than that of the first group, and a ratio of the particles of the first group in the alkaline earth metal oxide constituting the electron emissive material layer is 50 to 95% based on the atomic ratio of the alkaline earth metal oxide. Therefore, voids are formed at the position where the particles for producing voids in the electron emissive material layer are formed, while the crystalline particles of the alkaline earth metal oxide are randomly accumulated to form voids in the electron emissive material layer and, at the same time, the voids are supported thereby. Accordingly, a sufficient amount of electron emission can be obtained and unevenness of an electron emissive layer is decreased.

In the first and second process for preparing the oxide cathode of the cathode ray tube of the present invention, screen printing is used as a printing process and the paste for printing, which contains at least one of a nitrocellulose solution and an ethylcelluloce solution, terpineol and a dispersion agent, having a viscosity of 2,000 to 10,000 cP, is applied by using a mesh of No.120 to 500 in order to obtain a thickness of 40 to 150 $\mu$m for the paste for printing after the drying process. Accordingly, printing can be carried out in a condition that thickness becomes uniform and a ratio of inferior goods becomes small.

Since it is determined that the surface of the metal substrate forming the electron emissive material layer is a nearly circular shape having a diameter of r1 (mm) and the shape of an opening part of a mask for screen printing is a nearly circular shape having a diameter of r2 (mm), and satisfying $$r2 \leqq r1 - 0.1,$$

printing can be carried out in a uniform thickness.

Since the surface of the metal substrate is made concave, on which the electron emissive material layer is formed, electron emission surface can be leveled even though a viscosity of the paste for printing is lowered. Therefore, defects at printing can be reduced and at the same time, matching of the position between the cathode and an electron passing hole of the first grid can be easily carried out.

By making the shape of the paste for printing after drying or shape of the electron emissive material layer convex toward a direction of electron extraction, at least on the part from which the electron is extracted, it is possible to shorten the diameter of electron beam.

By making the surface of the metal substrate convex on which the electron emissive material layer is formed, it is possible to further shorten the diameter of electron beam accurately.

INDUSTRIAL APLICABILITY

The cathode ray tube of the present invention can be applied to Braun tube for display of television receiving apparatus and the like, camera tube, transmitting tube, discharge tube and the like.

What is claimed is:

1. A cathode ray tube comprising an oxide cathode, wherein an electron emissive material layer having an alkaline earth metal oxide is placed on a metal substrate containing nickel as a major component, said alkaline earth metal oxide comprises a mixture of needle-like particles of the first group and bulk particles of the second group which is different from the particles of the first group, an average length of the particles of the second group is at most 60% of that of the first group, an average diameter of the particles of the second group is at least 1.5 time larger than the first group, and a ratio of the particles of the first group in the alkaline earth metal oxide constituting the electron emissive material layer is 50 to 95% based on the atomic ratio of the alkaline earth metal oxide.

2. The cathode ray tube comprising an oxide cathode of claim 1, wherein the particles of the second group are spherical particles having an average diameter of at most 7 $\mu$m.

3. The cathode ray tube comprising an oxide cathode of claim 1, wherein the particles of the second group comprises at least oxide of barium and strontium, and a total amount of barium in the particles of the second group is at most 30% based on the atomic ratio of the alkaline earth metal oxide of the particles of the second group.

4. The cathode ray tube comprising an oxide cathode of claim 1, wherein a base on which an electron emissive material layer of a metal substrate is formed is a nearly circular shape having a diameter of r1 (mm) and a planar shape of the electron emissive material layer is a nearly circular shape having a diameter of r2 (mm), and the following equation is satisfied:

$$r2 \leqq r1 - 0.1.$$

5. The cathode ray tube comprising an oxide cathode of claim 1, further having a layer containing, as a main component, tungsten or molybdenum between the metal substrate and the electron emissive material layer.

6. The cathode ray tube comprising an oxide cathode of claim 1, wherein a cross sectional shape of a metal substrate surface on which an electron emissive material layer is formed is concave.

7. The cathode ray tube comprising an oxide cathode of claim 1, wherein a cross sectional shape of a metal substrate surface on which an electron emissive material layer is formed is convex.

8. A process for preparing a cathode ray tube containing an oxide cathode comprising a process for applying, by printing, a paste for printing containing particles of an alkaline earth metal carbonate forming an electron emissive material on a metal substrate which contains nickel as a main component and constitutes an oxide cathode, a drying process in which the paste for printing applied in the above process is fixed on the metal substrate, and a process for heating during forming a vacuum to oxidize the alkaline earth metal carbonate to an oxide as the electron emissive material after the oxide cathode is incorporated in the cathode ray tube, wherein as the alkaline earth metal carbonate in the paste for printing, there is used a mixture of needle-like particles of the first group and bulk particles of the second group which are different from the particles of the first group, an average length of the particles of the second group is at most 60% of that of the first group particle, an average diameter of the particles of the second group particle is at least 1.5 times larger than that of the first group particle, and an atomic ratio of the particles of the first group in the alkaline earth metal oxide constituting the electron emissive material layer is 50 to 95% based on the atomic ratio of the alkaline earth metal oxide.

9. A process for preparing a cathode ray tube containing an oxide cathode comprising a process for applying, by printing, the paste for printing containing particles of the alkaline earth metal carbonate forming the electron emissive material and particles for producing voids having an average diameter of 1 to 20 $\mu$m on the metal substrate which contains nickel as a main component and constitutes the oxide cathode, a drying process in which the paste for printing applied in the above process is fixed on the metal substrate, and a process for heating during forming a vacuum to oxidize the alkaline earth metal carbonate to an oxide as the electron emissive material after the oxide cathode is incorporated in the cathode ray tube, and in which the above particles for producing voids are removed while heating.

10. The process for preparing a cathode ray tube containing an oxide cathode of claim 9, wherein a volume ratio of the particles for producing voids against the alkaline earth metal carbonate is 5 to 30%.

11. The process for preparing a cathode ray tube containing an oxide cathode of claim 10, wherein the particles for producing voids is acrylic resin powder.

12. The process for preparing a cathode ray tube containing an oxide cathode of claim 9, wherein as the alkaline earth metal carbonate in the paste for printing, there is used a mixture of needle-like particles of the first group and bulk particles of the second group which is different from the particles of the first group, an average length of the particles of the second group is at most 60% of that of the first group, an average diameter of the particles of the second group is at least 1.5 times larger than that of the first group, and a ratio of the particles of the first group in the alkaline earth metal oxide constituting the electron emissive material layer is 50 to 95% based on the atomic ratio of the alkaline earth metal oxide.

13. The process for preparing a cathode ray tube containing an oxide cathode of claim 8, wherein the process for applying the paste by printing is carried out by using a screen printing.

14. The process for preparing a cathode ray tube containing an oxide cathode of claim 13, wherein the paste for printing contains at least one of a nitrocellulose solution and an ethylcelluloce solution, terpineol and a dispersion agent, the paste has a viscosity of 2,000 to 10,000 cP, a mesh of No. 120 to 500 is used during the process of applying the paste for printing and the thickness of the paste for printing after the drying process is 40 to 150 $\mu$m.

15. The process for preparing a cathode ray tube containing an oxide cathode of claim 13, wherein the surface of the metal substrate forming the electron emissive material layer is a nearly circular shape having a diameter of r1 (mm) and the shape of an opening part of a mask for screen printing is a nearly circular shape having a diameter of r2 (mm), and the following equation is satisfied:

$$r2 \leqq r1 - 0.1.$$

16. The process for preparing a cathode ray tube containing an oxide cathode of claim 8, wherein the surface of the metal substrate is concave, on which the electron emissive material layer is formed.

17. The process for preparing a cathode ray tube containing an oxide cathode of claim 8, wherein shape of the paste for printing after drying or shape of the electron emissive material layer is convex toward a direction of electron extraction, at least on the part from which the electron is extracted.

18. The process for preparing a cathode ray tube containing an oxide cathode of claim 17, wherein the surface of the metal substrate is convex on which the electron emissive material layer is formed.

* * * * *

UNITED STATES PATENT AND TRADEMARK OFFICE

CERTIFICATE OF CORRECTION

PATENT NO. : 6,376,976 B1
DATED : April 23, 2002
INVENTOR(S) : Kiyoshi Saitoh et al.

It is certified that error appears in the above-identified patent and that said Letters Patent is hereby corrected as shown below:

Column 6,
Line 62, change "at about 1000 to 140ºC" to -- at about 100 to 140ºC --; and Column 18,
Line 6, change "to about 400 cP" to -- to about 4000 cP --., Signed and Sealed this Nineteenth Day of November, 2002

*Attest:*

*Attesting Officer*

JAMES E. ROGAN
*Director of the United States Patent and Trademark Office*